US007583914B2

(12) United States Patent
Hatakeyama et al.

(10) Patent No.: US 7,583,914 B2
(45) Date of Patent: Sep. 1, 2009

(54) CHARGE MEMBER, CHARGE APPARATUS, PROCESS CARTRIDGE, AND IMAGE FORMING APPARATUS

(75) Inventors: Kumiko Hatakeyama, Kanagawa (JP); Toshiyuki Kabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 508 days.

(21) Appl. No.: 11/553,685

(22) Filed: Oct. 27, 2006

(65) Prior Publication Data

US 2007/0104512 A1 May 10, 2007

(30) Foreign Application Priority Data

Oct. 31, 2005 (JP) ..... 2005-316367
Nov. 7, 2005 (JP) ..... 2005-322747

(51) Int. Cl.
*G03G 15/02* (2006.01)

(52) U.S. Cl. ..... 399/168

(58) Field of Classification Search ..... 399/50, 399/115, 168, 174, 176; 361/225
See application file for complete search history.

(56) References Cited

U.S. PATENT DOCUMENTS 5,146,280 A * 9/1992 Kisu ..... 399/176
5,678,136 A * 10/1997 Watanabe et al. ..... 399/100
7,251,437 B2 * 7/2007 Tamoto et al. ..... 399/159

FOREIGN PATENT DOCUMENTS

| | | |
|---|---|---|
| JP | 52-36016 | 9/1977 |
| JP | 9-311526 | 12/1997 |
| JP | 2000-75701 | 3/2000 |
| JP | 2002-108059 | 4/2002 |
| JP | 2003-255679 | 9/2003 |
| JP | 2004-38056 | 2/2004 |
| JP | 2004-109151 | 4/2004 |
| JP | 2004-264792 | 9/2004 |
| JP | 2005-4000 | 1/2005 |

* cited by examiner

*Primary Examiner*—Robert Beatty
(74) *Attorney, Agent, or Firm*—Oblon, Spivak, McClelland, Maier & Neustadt, P.C.

(57) ABSTRACT

A charge member that can reduce charge irregularities of a member to be charged caused by variations in the gap between the member to be charged and the charge member even when using a member to be charged (photosensitive member, and the like) that has circumferential fluctuations. The charge member which is arranged electrically without making contact with the member to be charged, and which charges the member to be charged by applying AC voltage superimposed on DC voltage, and which is formed of a rotatable roller, is arranged electrically without making contact with the member to be charged having circumferential fluctuations of 4 to 80 μm within the image formation area, and which has a plurality of stage differences with a height difference of 2 to 30 μm on the surface of the roller; and the stage differences in the area opposing the member to be charged are five to thirty in relation to a distance of 0.5 mm in the circumferential direction of the roller. Charging without charge irregularities is thereby possible.

21 Claims, 10 Drawing Sheets

CHARGE MEMBER, CHARGE APPARATUS, PROCESS CARTRIDGE, AND IMAGE FORMING APPARATUS

BACKGROUND OF THE INVENTION

1. Field of the Invention

The present invention relates to a charge member, a charge apparatus that comprises the charge member, a process cartridge that comprises at least an image support member and a charge member, and to an image forming apparatus of a copier, printer or facsimile apparatus, and the like having the aforementioned charge member, charge apparatus, or process cartridge; and more particularly, relates to evaluation and judgment for determining the optimum gap between the image support member and the charge roller in order to conduct efficient charging.

2. Description of the Related Art

In image forming apparatuses that use an electronic photographic process, for example, after a visible image is formed by conducting the processes of charging, exposing and developing in relation to a photosensitive member, which is the image support member, the image is formed by using a transfer process to transfer the visible image on the photosensitive member to a transfer medium, and by using a fixing process to fix the image that was transferred onto the transfer medium.

In the past, scorotron charging devices were used in the aforementioned charging process to charge the photosensitive member, which is the member to be charged, but recently charge rollers have come to be used for the charge member in order to reduce the generation of harmful gases such as ozone and nitrous oxides (NOx) because of environmental concerns, and to allow the making of a more compact apparatus. In a charging mechanism using a charge roller for charging, discharge does not occur if the gap between the photosensitive member and the charge roller is too narrow, and the space on the Paschen side becomes 8 μm. However, the charge roller and the photosensitive member actually have a capacitance component, and therefore, discharge begins at 20 μm or more, and with a gap of 20 μm or more, the density of the discharge becomes smaller the wider the gap.

In the past, uniformity of resistance has been desired because if there were partial irregularities in the resistance of the charge roller, the charge would concentrate on the part with the lowest resistance value, and excessively large current would flow locally to generate charge irregularities. Moreover, with regard to the surface unevenness of the charge roller, in order to make it easier to concentrate discharge at the convex part it was desirable to have little surface roughness. In so-called contact charging that uses contact between the photosensitive member and the charge roller, discharge occurs when the gap of the region coming off the outer side a little from the nip becomes 20 μm or more. In order to allow the photosensitive member to charge up to a specific electric potential when charging by applying DC voltage to the charge roller, the only correct discharge opportunity for discharging to the photosensitive member from various points on the charge roller is the one instant when passing through the gap width along the Paschen side, and therefore, if the surface of the charge roller is uneven, irregularities of charge potential corresponding to that unevenness will be generated. Thus, a smooth charge roller that maintains a constant relative position between the charge roller and the photosensitive member has been sought.

Meanwhile, if AC voltage is superimposed on the DC voltage on the charge roller when charging, negative and positive discharging is repeated corresponding to the frequency, and because the charge potential is balanced with the value of the DC voltage applied, it is not always necessary for the charge roller surface to be smooth. For example, in Japanese Patent Application Laid-open No. 2000-75701, in an image forming apparatus that charges by having the charge roller and the photosensitive member make contact, studies were conducted on the unevenness of the photosensitive member and the charge roller, and on the positive addition of unevenness on the surface of the charge roller in order to form micro-spaces in the nip and generate discharge.

However, if the unevenness added to the surface of the charge roller is large, there is the possibility of damaging the photosensitive member because of contact between the photosensitive member and the charge roller, and therefore it is better to use a short-lived photosensitive member, but considering the durability of the photosensitive member, it is still preferable that the charge roller have a smooth surface.

Moreover, when forming an image by having the charge roller and the photosensitive member make contact, unless the toner remaining after transfer can be completely cleaned off, the remaining toner is caught between the charge roller and the photosensitive member, and causes irregularities of image concentration to occur by adhering to the charge roller and producing fluctuations in resistance, which brings about fluctuations of the charge potential of the photosensitive member. For that reason, as disclosed in Japanese Patent Application Laid-open No. 2004-264792, Japanese Patent Application Laid-open No. 2002-108059, and Japanese Patent Application Laid-open No. 2005-4000, so-called non-contact charging was proposed, in which the photosensitive member is charged by providing a gap between the photosensitive member and charge roller.

As previously described, because the density produced when discharging varies depending on the size of the gap, in contrast to contact charging, the gap between the photosensitive member and the charge roller must be accurately controlled in non-contact charging. For this reason, in the past a smooth shape was the ideal for the surface of the charge roller in non-contact charging. In this charging process, the photosensitive member is charged to the target voltage by simultaneously superimposing AC voltage when applying DC voltage to the charge roller. When AC voltage has been superimposed on the DC voltage on the roller, positive and negative discharge is repeated between the charge roller and the photosensitive member corresponding to the frequency, and the charge potential of the photosensitive member is equalized with the value of the DC voltage. The charging parameters at this time include the voltage and frequency of the alternating current applied, resistance irregularities of the charge roller, resistance irregularities of the photosensitive member, the gap between the photosensitive member and the charge roller, and gap variations. If there are gap variations, the discharge density varies depending on the gap, causing charge irregularities.

The dimensional precision of the photosensitive member and the charge roller, the installation precision, and vibration (fluctuation) may be cited as causes that produce gap variations. Of these, the dimensional precision of the photosensitive member and the charge roller may be raised to a precision unhindered by gap variations by setting suitable manufacturing conditions. Specifically, by studying the immersion coating conditions, the coating irregularities of the photosensitive member can be kept to under a few microns. Moreover, by increasing the strength of the spring and the precision of the charge roller or photosensitive member support member, it is also possible to reduce variations of installation precision enough so that discharge density variations do not become a problem.

On the other hand, reducing the vibration (fluctuation) of the photosensitive member is extremely difficult. Specifically, in order to suppress the vibration (fluctuation) of the photosensitive member, because the tube of the photosensitive member is comprised of a metal cylinder, it is necessary to make the aluminum, and the like cylindrical tube thicker, to heighten to an extreme the precision of the cylindrical tube and flange, and to raise the assembly precision of the cylindrical tube and flange. However, because the tube constitutes an extremely high percentage of cost of the photosensitive member, a very thick tube cannot be used in the photosensitive member. Moreover, because generally the flange is plastic, the photosensitive member is metal, and the flange is pressure fit to the cylindrical tube, there are limits to the precision in installing the photosensitive member drum and the flange, and normally the circumferential fluctuation can only be kept to about an average of 10 μm. Specifically, fluctuation can be minimized by selecting only photosensitive members with small fluctuation and making the flange out of metal, but these methods greatly heighten the cost of the photosensitive member. Here, fluctuation occurs even in the charge roller, but because the charge roller comprises a metal cylindrical column with a small external diameter, charge roller fluctuation can be ignored in relation to the vibration of the photosensitive member.

When charging a photosensitive member that fluctuates, the larger the frequency of the AC voltage applied to the charge roller, the higher the discharge density and the possibility of making the charge potential of the photosensitive member uniform. Nonetheless, if the frequency is too great, the photosensitive member and charge roller deteriorate faster, and therefore it is desirable to set the frequency as low as possible.

As indicated above, in order to prevent the occurrence of charge irregularities as much as possible, it is important to raise the dimensional precision of the photosensitive member and the charge roller, to raise the installation precision, and to lower vibration (fluctuation), which are the causes that generate variations in the gap between the charge roller and the photosensitive member. However, suppressing the deterioration of the photosensitive member and the charge roller, and reducing charge irregularities at low cost posed big problems for the prior art because of heightened production costs for the photosensitive member.

Technologies relating to the present invention are also disclosed in, e.g., Japanese Patent Application Laid-open No. S52-36016, Japanese Patent Application Laid-open No. H09-311526, and Japanese Patent Application Laid-open No. 2004-038056.

SUMMARY OF THE INVENTION

With the foregoing in view, in the past it was necessary to use an expensive member to be charged that had as little fluctuation as possible in order that the member to be charged of the photosensitive member, and the like had no charge irregularities, but an object of the present invention is to provide a charge member that reduces charge irregularities of the member to be charged caused by variations in the gap between the member to be charged and the charge member without shortening the lifespan of the member to be charged and the charge member even while using an inexpensive member to be charged that has some fluctuation.

Another object of the present invention is to provide a process cartridge that uses the aforementioned charge member or a charge apparatus that can reduce charge irregularities of the member to be charged using the aforementioned charge member.

A further object of the present invention is to provide a high image quality image forming apparatus or color image forming apparatus that reduces image concentration irregularities using the aforementioned charge apparatus or process cartridge.

In an aspect of the present invention, a charge member is arranged electrically without making contact with a member to be charged and charges the member to be charged by applying AC voltage superimposed on DC voltage. The charge member is formed of a rotatable roller and arranged electrically without making contact with the member to be charged having circumferential fluctuations of 4 to 80 μm within an image formation area. The charge member has a plurality of stage differences with a height difference of 2 to 30 μm on a surface of the roller. The stage differences in the area opposing the member to be charged are five to thirty in relation to a distance of 0.5 mm in the circumferential direction of the roller.

In another aspect of the present invention, a charge apparatus comprises a charge member arranged electrically without making contact with a member to be charged and a power source that applies voltage to the charge member. The member to be charged is charged by applying to the charge member AC voltage superimposed on DC voltage. The charge member is configured as a rotatable roller and is arranged electrically without making contact with the member to be charge with circumferential fluctuations of 4 to 80 μm in the image forming area. A plurality of stage differences having height differences of 2 to 30 μm are present on a surface of the roller. The stage differences in the area opposite the member to be charged are five to thirty in relation to a circumferential distance of 0.5 mm of the roller.

In another aspect of the present invention, a process cartridge is used in an image forming apparatus. At least two of a charge member, a charge apparatus and an image support are unified and assembled into a single cartridge. The charge member is arranged electrically without making contact with a member to be charged and charges the member to be charged by applying AC voltage superimposed on DC voltage. The charge member is formed of a rotatable roller and arranged electrically without making contact with the member to be charged having circumferential fluctuations of 4 to 80 μm within an image formation area. The charge member has a plurality of stage differences with a height difference of 2 to 30 μm on a surface of the roller, and in which the stage differences in the area opposing the member to be charged are five to thirty in relation to a distance of 0.5 mm in the circumferential direction of the roller. The charge apparatus comprises a power source which applies voltage to the charge member and charges the member to be charged by applying AC voltage superimposed on DC voltage to the charge member. The image support is the member to be charged.

In another aspect of the present invention, an image forming apparatus comprises an image forming unit that has an image support that is a member to be charged, charge means that charges the image support, and means to form an image on the image support. The charge means comprises at least one of a charge member and a charge apparatus. The charge member is arranged electrically without making contact with a member to be charged and charges the member to be charged by applying AC voltage superimposed on DC voltage. The charge member is formed of a rotatable roller and arranged electrically without making contact with the member to be charged having circumferential fluctuations of 4 to 8 μm within an image formation area. The charge member has a plurality of stage differences with a height difference of 2 to 30 μm on a surface of the roller and the stage differences in the area opposing the member to be charged are five to thirty in relation to a distance of 0.5 mm in the circumferential direction of the roller. The charge apparatus comprises a power source that applies voltage to the charge member and charges the member to be charged by applying AC voltage superimposed on DC voltage to the charge member.

In another aspect of the present invention, an image forming apparatus comprises an image forming unit that has an image support that is a member to be charged, a charge member that charges the image support, and means to form an image on the image support. The image forming unit comprises a process cartridge in which at least two of a charge member, a charge apparatus and an image support are unified and assembled into a single cartridge. The charge member is arranged electrically without making contact with a member to be charged, and which charges the member to be charged by applying AC voltage superimposed on DC voltage. The charge member is formed of a rotatable roller and arranged electrically without making contact with the member to be charged having circumferential fluctuations of 4 to 80 μm within the image formation area. The charge member has a plurality of stage differences with a height difference of 2 to 30 μm on a surface of the roller and the stage differences in the area opposing the member to be charged are five to thirty in relation to a distance of 0.5 mm in the circumferential direction of the roller. The charge apparatus comprises a power source that applies voltage to the charge member and charges the member to be charged by applying AC voltage superimposed on DC voltage to the charge member. The image support is the member to be charged.

In another aspect of the present invention, an image forming apparatus conducts a charging process by applying AC voltage superimposed on DC voltage to an image support and a charge roller is arranged electrically without making contact with the image support. Circumferential fluctuations, in the image forming area, of the image support are 4 to 80 μm. The charge roller has a plurality of stage differences on the surface thereof that have height differences of 2 to 30 μm and lengths of 400 μm or more. When plotting the continuous stage differences respectively by extracting to an XY plane taking the longitudinal axis of the roller as the X axis and conducting collinear approximation by the least squares method, the correlation coefficient is 0.9 or less, and the slope is −0.5 to 0.5.

In another aspect of the present invention, a process cartridge can be mounted in an image forming apparatus. The mage forming apparatus conducts a charging process by applying AC voltage superimposed on DC voltage to an image support and a charge roller is arranged electrically without making contact with the image support. Circumferential fluctuations in the image forming area of the image support are 4 to 80 μm. The charge roller has a plurality of continuous stage differences on the surface thereof that have height differences of 2 to 30 μm and lengths of 400 μm or more. When plotting the stage differences respectively by extracting to an XY plane taking the longitudinal axis of the roller as the X axis and conducting collinear approximation by the least squares method, the correlation coefficient is 0.9 or less, and the slope is −0.5 to 0.5.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
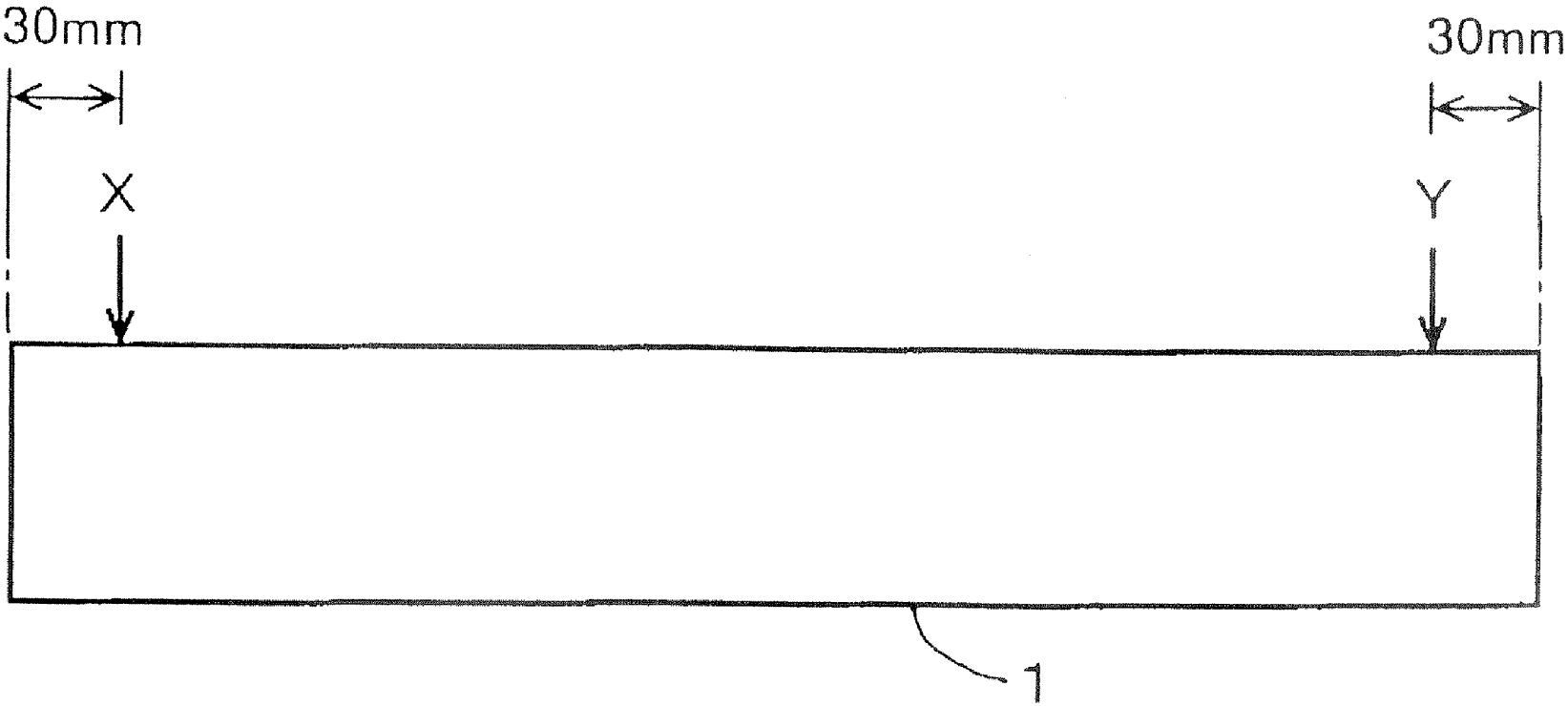
FIG. 1 is a diagram indicating one example of the measurement locations of circumferential fluctuation of the photosensitive member.

Embodiments for implementing the present invention will be explained below in detail.

First, the inventors studied whether discharge irregularities and the accompanying photosensitive member charge irregularities caused by variations in the gap between a photosensitive member and a roller-shaped charge member (called a charge roller hereinafter) when using an inexpensive photosensitive member having some fluctuation could somehow be reduced without shortening the lifespan of the photosensitive member and the charge roller. Then, as a result of observing the variations in the gap between the photosensitive member and the charge roller in detail, the present inventors found that, because the fluctuation of the photosensitive member does not vibrate finely, but rather fluctuates loosely in a precession motion, when the surface shape of the charge roller is uniform, the gap varies loosely, charge irregularities are prone to be generated slowly and cyclically by having a gap in the circumferential direction of the photosensitive member, and the accompanying image concentration irregularities are easily noticeable to the human eye.

Because the fluctuation of the photosensitive member cannot be controlled in relation to the cost of the photosensitive member as previously described, the present inventors intensely studied whether the gap irregularities could be resolved by the shape of the charge roller, and discovered that when stage differences are made present in the circumferential direction of the charge roller, the strength at which discharge occurs changes to fine before and after the stage difference, and therefore the gradual charge irregularities in conjunction with the fluctuation of the photosensitive member could be resolved if the number of stage differences becomes a fixed amount or more.

Embodiment 1

First, the present Embodiment 1 will be summarized below.

(1) The present Embodiment 1 is a charge member that is arranged electrically without making contact in relation to a photosensitive member as the member to be charged, and that charges the photosensitive member by applying AC voltage superimposed on DC voltage, wherein the charge member is configured by a rotatable roller, is arranged electrically without making contact in relation to the photosensitive member with a circumferential fluctuation in the image formation area of 4 to 80 μm, and has a plurality of stage differences with a height difference of 2 to 30 μm on the surface of the aforementioned roller, and the aforementioned stage differences in the region opposite the photosensitive member are present in 5 to 30 lines in relation to a distance of 0.5 mm in the circumferential direction of the aforementioned roller. More concretely, there are a plurality of stage differences on the surface of the charge roller used in the image forming apparatus of the present Embodiment 1, and height difference of the stage difference is 2 to 30 μm, preferably 3 to 20 μm, and more preferably 4 to 15 μm. A stage difference of 2 μm or less is not preferable because the effect to mitigate variations in the gap based on the stage differences does not appear, and 30 μm or more is not preferable because the most concave parts of the stage differences of the charge roller are at too great a distance from the photosensitive member and have difficulty discharging, and in order to make those parts discharge it is necessary to increase the voltage of the alternating current applied to the charge roller, and if increased too much, a large amount of ozone will be produced.

(2) Preferably the stage differences of the charge roller used in the image forming apparatus of the present Embodiment 1 comprise height differences of 2 to 30 μm, and the stage differences have a steep height difference with a width of 10 μm or less, preferably 5 μm or less, and more preferably between 0.1 to 3 μm.

(3) When the number of stage differences on the charge roller surface of the present Embodiment 1 is in the range of 5 to 30 lines, preferably 6 to 25 lines, and more preferably 7 to 20 lines, the efficiency is good. It is not preferable for the frequency of having stage differences to be less than 5 lines in relation to a distance of 0.5 mm circumferentially because no notable effect to absorb charge irregularities appears, and it is not preferable for the frequency of having stage differences to be 30 lines or more in relation to a distance of 0.5 mm circumferentially because faults are prone to be generated in the surface of the roller, and faults become charge irregularities.

(4) When counting the number of stage differences in the circumferential direction of the charge roller of the image forming apparatus of the present Embodiment 1, ideally it is preferable to count the number of lines per distance of 0.5 mm circumferentially across the entire surface of the charge roller, but as long as the stage differences are not unevenly distributed on the surface of the charge roller, the number of stage differences within the region of part of the charge roller surface may be counted, and it is best to count at 3 to 10 locations the number of lines of stage differences that have been extracted in relation to a distance of 0.5 mm circumferentially in the region of part of the charge roller surface.

(5) The photosensitive member and charge roller used in the image forming apparatus of the present Embodiment 1 are electrically arranged without making contact, and the average gap between the photosensitive member and the charge roller is 10 to 150 μm, preferably 14 to 100 μm, and more preferably 18 to 60 μm. It is not preferable that the average gap between the photosensitive member and the charge roller be less than 10 μm because the photosensitive member and the charge roller are too close, and toner that has not been cleaned off is prone to catch between the photosensitive member and the charge roller, producing abnormal images with streaks. Moreover, it is not preferable that the average gap between the photosensitive member and the charge roller be more than 150 μm because in order to cause discharge it is necessary to increase the voltage of the alternating current applied to the charge roller, and if increased too much, a large amount of ozone will be produced.

(6) The circumferential fluctuation in the image formation area of the photosensitive member used in the image forming apparatus of the present Embodiment 1 is 4 to 80 μm, preferably 7 to 50 μm, and more preferably 8 to 30 μm. It is not preferable for the circumferential fluctuation of the photosensitive member to be less than 4 μm in that the production costs of the photosensitive member become extremely high, and more than 80 μm is not preferable because if the fluctuations are too large the photosensitive member and the charge roller make violent contact and damage the photosensitive member, and if photosensitive member and the charge roller come too close, toner that has not been cleaned off is prone to catch between the photosensitive member and the charge roller, producing abnormal images with streaks. Further, the definition in JIS B 0621 "Circumferential fluctuation in the radial direction" is followed to measure the circumferential fluctuation in the image formation region of the photosensitive member, and the circumferential fluctuations of the present Embodiment 1 shall be the largest values therein. However, generally the fluctuations of the photosensitive member tend to become larger closer to the end parts as indicated in FIG. 1, measurements are taken at 2 points (X, Y) 30 mm from both ends of the photosensitive member (the ends are the ends of the tube not including the flange parts), and the larger value when comparing the "circumferential fluctuation in the radial direction" at the two points (X, Y) may be adopted. To measure the circumferential fluctuation the surface of photosensitive member was measured using a non-contact dimension measurement apparatus (Laser Scan Micrometer manufactured by Mitsutoyo Co., Ltd.). Moreover, the measurements were taken with the flange installed in the photosensitive member.

(7) Because there are large differences in the functions of absorbing and mitigating cyclic charge irregularities that are easily noticeable to the human eye and that are produced depending on the linearity and slope of the continuous stage differences on the surface of the charge roller, the linearity and slope must be stipulated. Thus, for the stage differences of the roller surface in the present Embodiment 1, the correlation coefficient and slope when conducting collinear approximation of the stage difference based on the least squares method are stipulated by taking the longitudinal direction of the charge roller as the X axis direction, and sampling and plotting the distance Yn from the X axis of an optional X (Xn) extracted to an XY plane at an interval such that the number of sampling points is 10 points or more.

(8) If completely linear, the collection of plot points when the continuous stage differences are extracted to an XY plane will be cyclic irregularities easily noticeable to the human eye; therefore, it is better if the continuous stage differences gradually meander, and the degree of meandering is satisfactory if the correlation coefficient when conducting collinear approximation of the stage difference based on the least squares method is 0.9 or less (excluding 0), preferably 0.4 or less (excluding 0), and more preferably 0.1 or less (excluding 0). It is not preferable for the correlation coefficient to be greater than 0.9 because the linearity is too high, and no contribution is made to mitigating cyclic irregularities.

(9) A meandering line extracted to an XY plane that extends without holding the angle in the entire longitudinal direction also is prone to generate cyclic irregularities easily noticeable to the human eye, and therefore, it is better if the continuous stage differences hold the angle, and the degree of slope is satisfactory if the slope when conducting collinear approximation of the stage difference based on the least squares method is −0.5 to 0.5, preferably −0.3 to 0.3, and more preferably −0.1 to 0.1. It is not preferable for the slope to be less than −0.5 or more than 0.5 because cyclic irregularities easily occur. The stage differences of the present Embodiment 1 are continuous across a length of at least 100 μm, preferably 400 μm.

(10) The cycles of AC voltage applied to the charge roller used in the image forming apparatus of the present Embodiment 1 are suitably selected based on the linear speed of the photosensitive member and the resolution of the image forming apparatus, but specifically, 800 to 2000 Hz is preferable, 900 to 1700 Hz is more preferable, and 1000 to 1600 Hz is even more preferable. It is not preferable to have AC voltage cycles of less than 800 Hz because notable charge irregularities appear; and it is not preferable to have AC voltage cycles of more than 2000 Hz because the deterioration of the charge roller and the photosensitive member is accelerated.

The present Embodiment 1 will be explained in detail below while referring to the diagrams.

Figure 2A:
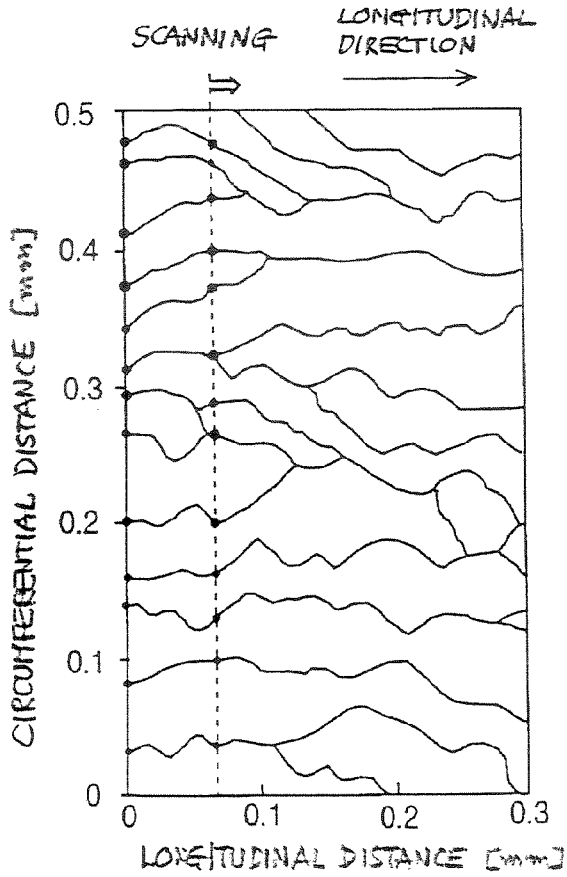
FIG. 2A is a graph in which the surface of the center of the charge roller used in the image forming apparatus related to Embodiment 1 of the present invention is taken as a SEM image using a scanning electron microscope (SEM), and then all of the stage differences with a height difference of 2 to 30 μm were extracted and plotted.
Figure 2B:
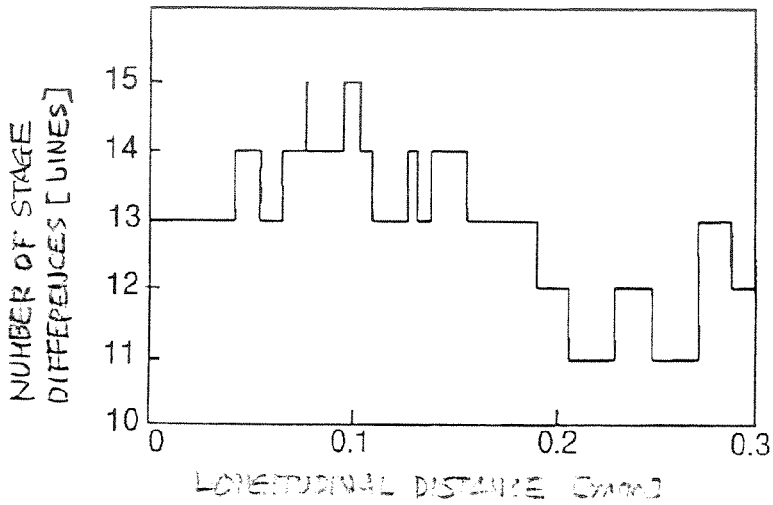
FIG. 2B is a diagram indicating the changes in the number of stage differences per circumferential distance of 0.5 mm of the charge roller relating to the number of stage differences indicated in FIG. 2A when counted by scanning longitudinally.

An example of the surface of the charge roller used in image forming apparatus of the present Embodiment 1 is indicated in FIG. 2A. In FIG. 2A the surface of the central part of the charge roller used in the image forming apparatus of the present Embodiment 1 was observed using a three-dimensional scanning electron microscope (SEM), and after incorporating as a SEM image, the stage differences with a height difference of 2 to 30 μm were extracted. The horizontal direction in FIG. 2A indicates the longitudinal direction (axial direction) of the charge roller, and the vertical direction indicates the circumferential direction of the charge roller. It is not necessary for the stage differences on the roller surface to be linked, but it is preferable that the stage differences be linked from the point of view that linking makes it difficult for the stage differences to be unevenly distributed. A line with a length of 0.5 mm perpendicular to the longitudinal direction of FIG. 2A is drawn, and the number of intersecting stage differences are counted in relation to the line with a length of 0.5 mm circumferentially. The line plotted in this circumferential direction is scanned in the longitudinal direction, and the number of stage differences at the respective locations is counted. FIG. 2B indicates the number of stage differences per distance of 0.5 mm in the circumferential direction of the charge roller when scanning and counting in the longitudinal direction the number of lines of stage difference in FIG. 2A. The number of lines of stage difference of the charge roller in FIG. 2A varies from 11 to 15 lines. When using the same method to count the number of lines of stage difference for the part 50 mm inside from the ends of the aforementioned charge roller, there were 10 to 15 lines at the part 50 mm inside from the left end, and 11 to 16 lines at the part 50 mm inside from the right end.

The charge process using the charge roller of the present Embodiment 1 will be explained in detail.

Figure 3:
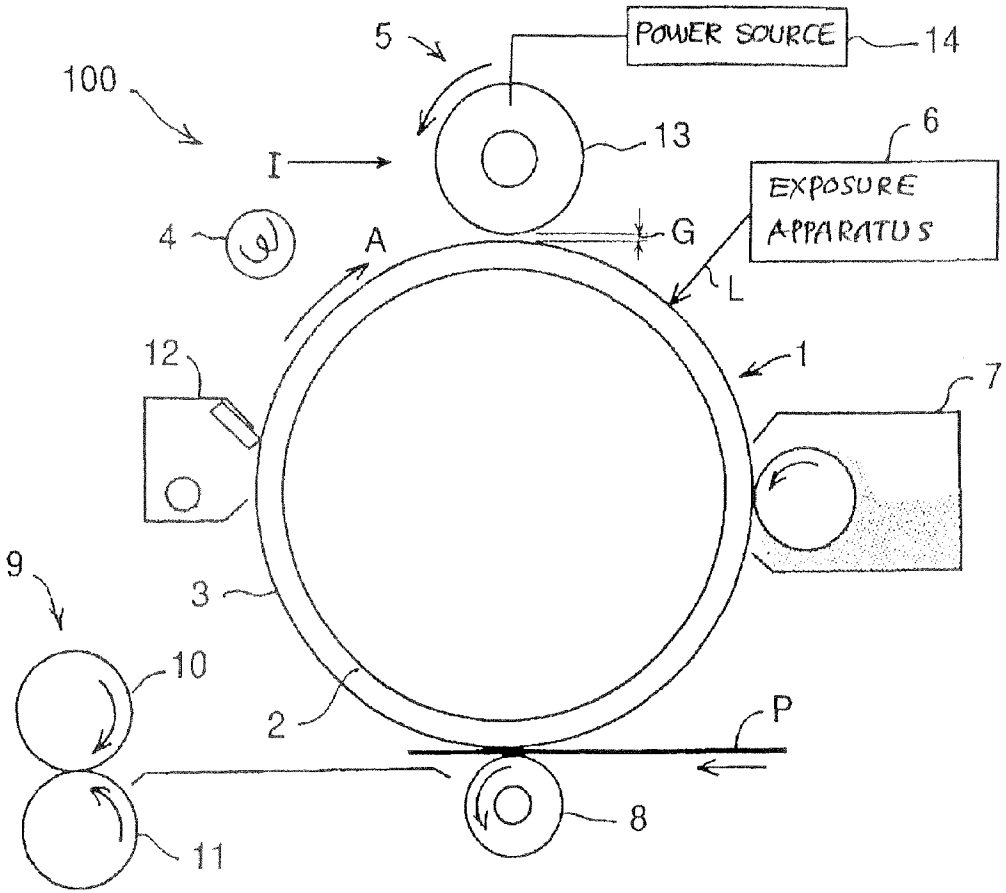
FIG. 3 is a diagram indicating the schematic configuration of an image forming apparatus relating to the present Embodiment 1.

The schematic configuration of the image forming apparatus related to the present Embodiment 1 is indicated in FIG. 3. The image forming apparatus 100 indicated here comprises a copier, printer, facsimile apparatus or a complex machine providing at least 2 of these functions. A photosensitive member 1, which is one example of an image support member to be charged, is arranged in the housing of the main unit not indicated in the diagram, and this photosensitive member 1 comprises a photosensitive member in which a photosensitive layer 3 is laminated on the outer surface of a drum-shaped electro-conductive support 2. Further, instead of this kind of drum-shaped photosensitive member, it is also possible to use a belt-shaped photosensitive member that travels and is driven around multiple rollers, or a drum-shaped or belt-shaped photosensitive member comprising a dielectric substance.

Further, in the present Embodiment 1, a process cartridge unit is configured with at least the photosensitive member 1 and a charge apparatus 5, and it is also possible to further configure the process cartridge unit by adding a developer apparatus, a cleaning unit, and a neutralization apparatus. The above cartridge unit alone can be called a process cartridge, but there can be many variations such as a combined charge apparatus, photosensitive member, and developer apparatus, or a combined charge apparatus, photosensitive member, developer apparatus, and cleaning apparatus, and the like.

Arranged around the photosensitive member 1 are a charge apparatus 5 for forming an image based on an electronic photographic process, a exposure apparatus 6, a developer apparatus 7, a transfer apparatus 8, a cleaning apparatus 12, and a neutralization apparatus 4. Further, although omitted from the diagram, a paper feed apparatus (paper feed cassette, paper feed roller, resist roller, and the like), which feeds transfer material such as transfer paper P to the transfer unit (part opposing the photosensitive member 1 and the transfer apparatus 8 (also called the transfer nip)) is provided on the upstream side in the transfer material transport direction of the transfer apparatus 8; and a fixing apparatus 9 and a paper discharge apparatus (paper discharge roller, paper discharge tray, and the like) not indicated in the diagram are provided on the downstream side in the transfer material transport direction of the transfer apparatus 8.

During the image forming operation, the photosensitive member 1 is rotated and driven in the clockwise direction in FIG. 3, and the surface thereof moves in the direction of the arrow A in the diagram. At this time, light from the neutralization apparatus 4 (for example, neutralization lamp) is irradiated on the surface of the photosensitive member, that surface is initialized, and next the surface of the photosensitive member is charged to the specified polarity by a charge roller 13 of the charge apparatus 5. The charge apparatus 5 will be explained in detail later.

Optically modulated light flux L emitted from a laser scanning type write unit (or a write unit using a light emitting diode (LED) array and the like), which is one example of the exposure apparatus 6, is irradiated on the surface of the photosensitive member charged by the charge apparatus 5, and an electrostatic latent image is thereby formed on the surface of the photosensitive member. Next, when passing through the developer apparatus 7, this electrostatic latent image is made into a visible toner image based on toner charged to a specified polarity.

Meanwhile, the transfer material P comprising, for example, transfer paper is fed by a paper feed apparatus not indicated in the diagram to the transfer unit between the photosensitive member 1 and the transfer apparatus 8 (for example a transfer roller) arranged opposite the photosensitive member 1 at a specified timing, and at this time the toner image formed on the photosensitive member is transferred electrostatically onto the transfer material P. The transfer material P on which the toner image is transferred passes between a pressure roller 11 and a fixing roller 10 of the continuous fixing apparatus 9; the toner image is fixed on the transfer material at this time by the action of heat and pressure, and a fixed image is obtained. Meanwhile, the transfer residual toner that is not transferred to the transfer material and remains on the surface of the photosensitive member is removed by the cleaning apparatus 12, and the surface of the photosensitive member after cleaning is neutralized by the neutralization apparatus 4.

The charge apparatus 5 has the charge roller 13 arranged opposite the surface of the moving member to be charged (the photosensitive member 1 in the example indicated in the diagram), and a power source 14 that applies voltage to the charge roller 13. The power source 14 applies AC voltage superimposed on the DC voltage on the charge roller 13, discharge is produced between the charge roller 13 and the surface of the photosensitive member 1, and the aforementioned surface of the photosensitive member is charged to a specified polarity.

The charge roller 13 indicated in FIG. 3 is formed into a cylinder, and the entire body can be made of metal such as stainless steel. However, a configuration coated with rubber or a plastic material on the outside of the cylindrical metal is used because contact with the photosensitive member 1 when installing the charge roller 13 can damage the photosensitive member 1.

The charge roller 13 indicated in FIG. 3 makes no contact with the surface of the photosensitive member, and the gap G between the photosensitive member 1 and the charge roller 13 is arranged to an average 10 to 150 μm, preferably 14 to 100 μm, and more preferably 18 to 60 μm. It is not preferable for the average gap between the photosensitive member 1 and the charge roller 13 to be less than 10 μm because the photosensitive member 1 and the charge roller 13 are too close, and toner that has not been cleaned off is prone to catch between the photosensitive member 1 and the charge roller 13, producing abnormal images with streaks. Moreover, it is not preferable for the average gap between the photosensitive member 1 and the charge roller 13 to be more than 150 μm because in order to cause discharge it is necessary to increase the voltage of the alternating current applied to the charge roller 13, and if too great, a large amount of ozone will be produced.

Figure 4:
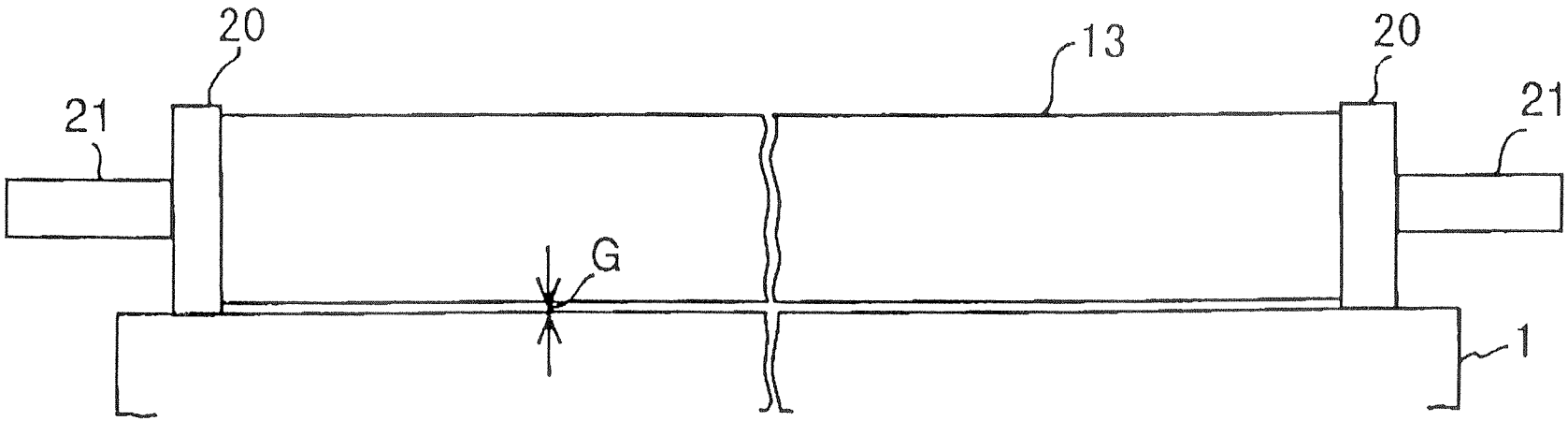
FIG. 4 is a diagram indicating one example of the charge roller of the same image forming apparatus, and is a schematic front view diagram of the charge roller viewed from the direction of FIG. 3.

FIG. 4 indicates one example of a configuration for arranging the charger roller 13 opposite the surface of the photosensitive member with a micro-gap G. Affixed to the charge roller 13 indicated here are spacers 20 comprising resin tape or rings on the end regions in the longitudinal direction (direction of axle 21), and the charge roller 13 maintains the micro-gap G in relation to the surface of the photosensitive member by these spacers 20 contacting the surface of the photosensitive member. In addition, the micro-gap can be guaranteed by using a flange or the like on the ends of the roller.

With the image forming apparatus of the present Embodiment 1, it highly preferable to unify at least the photosensitive member 1 and the charge roller 13 and the like, and when formed into a so-called process cartridge that is handled as a removable part, the maintenance characteristics are notably improved.

Figure 5:
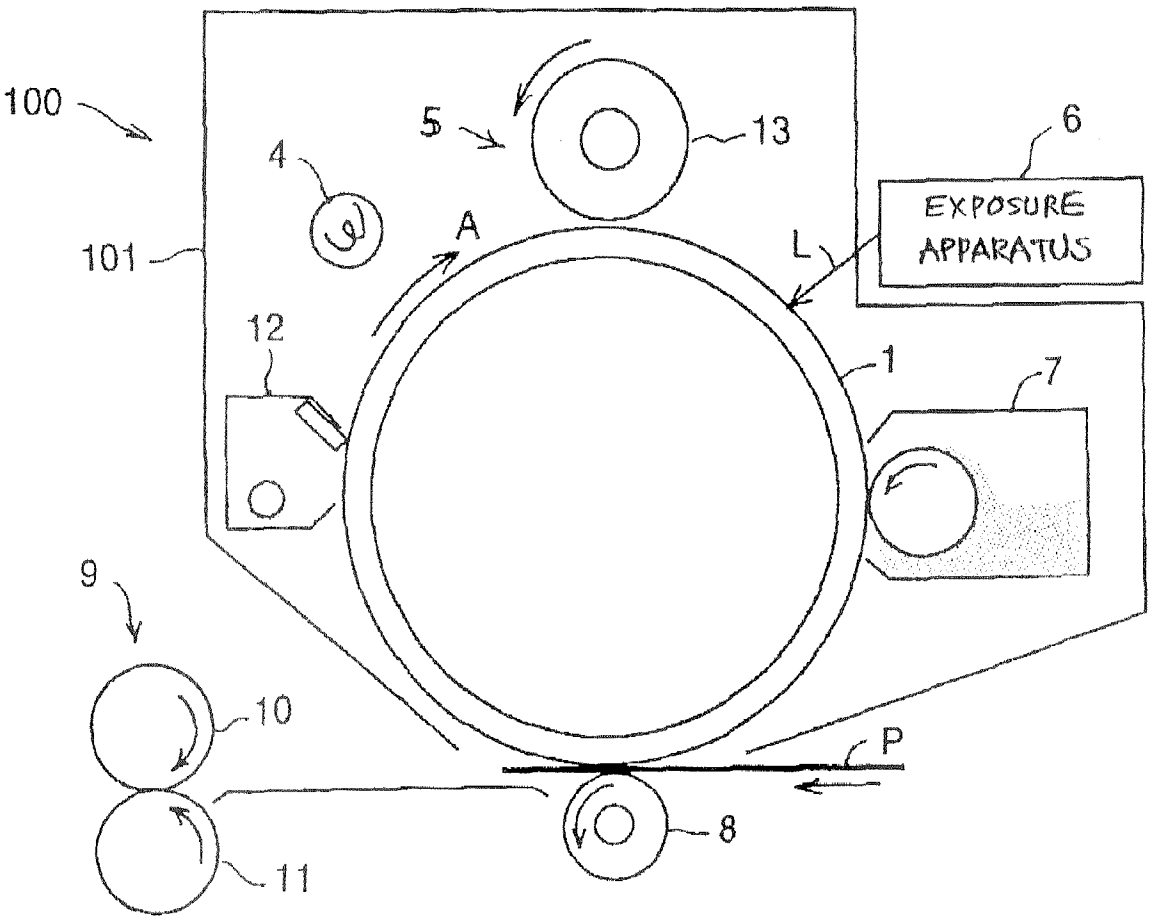
FIG. 5 is a diagram indicating the schematic configuration of the image forming apparatus of Embodiment 1 that uses a process cartridge.

FIG. 5 indicates an example of the configuration of an image forming apparatus using a process cartridge, and in this image forming apparatus 100, The photosensitive member 1, charge roller 13, developer apparatus 7, cleaning apparatus 12, and neutralization apparatus 4 are assembled as a single unit in one process cartridge 101, and this process cartridge 101 is configured to attach and detach freely in relation to the main unit of the image forming apparatus. Consequently, if a problem arises with the photosensitive member 1 or the surrounding members, the cartridge can be replaced, and the maintenance characteristics are notably improved.

Because the stage differences on the surface of the charge roller 13 of the present Embodiment 1 have a height of 2 μm or more, the stage differences can be readily determined from height information obtained by a laser microscope or a 3-dimensional scanning electron microscope (SEM), or by using a stylus surface roughness meter.

Methods to effectively produce stage differences on the surface of the charge roller 13 include: producing stage differences by mechanical grinding or by a drawing means; utilizing volume changes when manufacturing the resin used in the charge roller 13; and pre-forming stage differences on the inner surface of the metal die in the casting process. Of these, pre-forming stage differences on the inner surface of the metal die in the casting process is preferable because the casting die is fixed, and when mass producing charge rollers, the preferred surface shape can be manufactured with satisfactory reproducibility.

The configuration of the layers of the charge roller 13 used in the image forming apparatus of the present Embodiment 1 are preferably configured from a high-polymer layer and a surface layer on top of a electro-conductive substrate.

The electro-conductive substrate functions as an electrode and a supporting member of the charge roller 13, and comprises electro-conductive materials, for example, metal or metal alloy such as aluminum, copper alloy or stainless steel; iron plated with chromium or nickel; an electro-conductive resin, and the like.

An electro-conductive layer having resistance of $10^6$ to $10^9$ Ω cm is preferable as the high-polymer layer, and an electro-conductive agent mixed in a high-polymer material to adjust the resistance can be used. High-polymers for the high-polymer layer of the charge roller 13 used in the image forming apparatus of the present Embodiment 1 include: polyester group, olefin group thermoplastic elastomers, styrene group thermoplastic resins such as polystyrene, styrene-butadiene copolymer, styrene-acrylonitrile copolymer, styrene-butadiene-acrylonitrile copolymer, isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene-propylene rubber, epichlorohydrin-ethylene oxide copolymer rubber, epichlorohydrin-ethylene oxide-allylglycidyl ether copolymer rubber, ethylene-propylene-diene ternary copolymer rubber (EPDM), acrylonitrile-butadiene copolymer rubber, natural rubber, and blended rubber thereof. Among them, silicone rubber, ethylene-propylene rubber, epichlorohydrin-ethylene oxide copolymer rubber, epichlorohydrin-ethylene oxide-allylglycidyl ether copolymer rubber, acrylonitrile-butadiene copolymer rubber, and blended rubber thereof are preferably used. These rubber materials may be a foamed rubber or unfoamed rubber.

As the electro-conductive agent, an electronic electro-conductive agent or ionic electro-conductive agent can be used. Examples of the electronic electro-conductive agent include fine powder of: carbon black such as Ketjen Black or acetylene black; pyrolytic carbon, graphite; various kinds of electro-conductive metal or metal alloy such as aluminum, copper, nickel or stainless steel; various kinds of electro-conductive metal oxide such as tin oxide, indium oxide, titanium oxide, tin oxide-antimony oxide solid solution, or tin oxide-indium oxide solid solution; insulating materials having a surface treated by an electro-conductive process; and the like. Further, examples of ionic electro-conductive agents include: perchlorates or chlorates of tetraethylammonium, lauryl trimethyl ammonium and the like; perchlorates or chlorates of alkali metal such as lithium or magnesium, and alkali earth metal; and the like. These electro-conductive agents may be used singly or in combinations of 2 types or more. Moreover, the amount added is not particularly limited, but with the aforementioned electro-conductive agents, a range of 1 to 30 weight parts to 100 weight parts of high-polymer is preferable, and a range of 15 to 25 weight parts is more preferable. Meanwhile, with the aforementioned ionic electro-conductive agents, a range of 0.1 to 5.0 weight parts to 100 weight parts of high-polymer is preferable, and a range of 0.5 to 3.0 weight parts is more preferable.

As stated previously, a polymer material that comprises the aforementioned surface layer is not particularly limited as long as the surface of the charge roller 13 has the dynamic ultra-microhardness ranging from 0.04 to 0.5. Examples of the polymer materials include polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, ethylene-vinyl acetate copolymer, and the like.

Among these materials, polyamide, polyvinylidene fluoride, tetrafluoroethylene copolymer, polyester and polyimide are preferably used from the standpoint of releasing properties from a toner. The above-described polymer materials may be used either singly or in combination of two or more types thereof. Further, the number average molecular weight of the high-polymer material is preferably in the range of 1,000 to 100,000, and more preferably in the range of 10,000 to 50,000.

The surface layer is formed as a composition by mixing into the aforementioned high-polymer material the electro-conductive agent used in the aforementioned electro-conductive elastic layer and various types of microparticles. Silicon oxide, metal oxides and composite oxides such as aluminum oxide and barium titanate, and high-polymer micro-powders such as tetrafluoroethylene and vinylidene fluoride can be used singly or mixed as the aforementioned microparticles, but the microparticles are not particularly limited thereto. The surface layer is 0.5 to 12 μm so that the shape of the stage differences is not lost, preferably 1 to 10 μm, and more preferably 2 to 8 μm. If the surface layer is less than 0.5 μm, the layer is too thin, and this is not preferable because of notable unevenness in which there may be areas where locally there is no surface layer and areas where there is a surface layer, and the like. If the surface layer is more than 12 μm, the surface layer hides the stage differences, and the function to mitigate charge irregularities by the presence of the stage differences, which is an object of the present invention, cannot be manifested.

A photosensitive layer 3 is provided on the electro-conductive support 2 of the photosensitive member 1 used in the image forming apparatus of the present Embodiment 1. The configuration of the photosensitive layer is the single layer type, in which a charge-generating material and a charge-transmitting material are mixed, or the ordered layer type, in which the charge-transmitting layer is provided on the charge-generating material, or the inverted layer type, in which the charge-generating layer is provided on the charge-transmitting layer. In addition, a protective layer can be provided on the photosensitive layer. An undercoat layer may also be provided between the photosensitive layer and the electro-conductive support. Further, suitable amounts of plasticizers, antioxidants, and leveling agents can be added to the various layers as necessary.

The electro-conductive support 2 exhibits electro-conductive properties of a volume resistivity of $10^{10}$ Ω cm or less, and can be prepared by using deposition or sputtering to coat metals such as aluminum, nickel, chromium, nichrome, copper, silver, gold, platinum, and iron, or metallic oxides such as tin oxide and indium oxide on cylindrically shaped plastic or paper. Alternatively, a plate of aluminum, aluminum alloys, nickel, or stainless steel may be formed into a drum by a method such as extrusion or drawing. Subsequently, the tube may be subjected to surface treatment such as cutting, superfinishing or polishing, and then used. A drum-shaped support with a diameter of 20 to 150 mm can be used; preferably the diameter is 24 to 100 mm, and more preferably 28 to 70 mm. If the diameter of the drum-shaped support is less than 20 mm, it is difficult to arrange such processes as charging, exposure, development, transfer and cleaning around the drum; and if the diameter the drum-shaped support is more than 150 mm, the size of image forming apparatus increases and is not preferable. Specifically, if the image forming apparatus is the previously described tandem type, multiple photosensitive members must be mounted, and therefore, it is preferable for the diameter to be 70 mm or less, preferably 60 mm or less. Moreover, the endless nickel belt or endless stainless steel belt disclosed in Japanese Patent Application Laid-open No. S52-36016 can also be used as the electromagnetic support.

A resin, a substance having main components of a white pigment and a resin, and a metal oxide film in which the surface of the electro-conductive substrate has been chemically or electrochemically oxidized may be cited as examples of the undercoat layer of the photosensitive member used in the image forming apparatus of the present Embodiment 1, but a substance having main components of a white pigment and a resin is preferable. Metal oxides such as titanium oxide, aluminum oxide, zirconium oxide, and zinc oxide may be cited as white pigments, and among these, most preferable is to contain titanium oxide, which has superior properties to prevent charge infusion from the electro-conductive substrate. Preferable examples of the resin for use in the undercoat layer include thermoplastic resins such as polyamide, polyvinyl alcohol, casein, and methyl cellulose, and thermosetting resins such as acryl, phenol, melamine, alkyd, non-foaming polyester, and epoxy; and these resins can be used singly or by mixing multiple types.

Examples of the charge-generating substance of the photosensitive member used in the image forming apparatus of the present Embodiment 1 include: organic pigments or dyes such as monoazo pigment, bisazo pigment, trisazo pigment, tetrakisazo pigment, triarylmethane dye, thiazine dye, oxazine dye, xanthene dye, cyanine dye, styryl dye, pyrylium dye, quinacridone pigment, indigo pigment, perylene pigment, polycyclic quinone pigment, bisbenzimidazole pigment, indanthrene pigment, squarilium pigment, phthalocyanine pigment and the like; and inorganic materials such as selenium, selenium-arsenic alloy, selenium-tellurium alloy, cadmium sulfide, zinc oxide, titanium oxide, amorphous silicon, and the like. These charge-generating substances can be used singly or by mixing multiple types.

Examples of the charge-transmitting substance of the photosensitive member used in the image forming apparatus of the present Embodiment 1 include: anthrathene derivative, pyrene derivative, carbazole derivative, tetrazole derivative, metallocene derivative, phenothiazine derivative, pyrazoline compound, hydrazone compound, styryl compound, styryl hydrazone compound, enamine compound, butadiene compound, distyryl compound, oxazole compound, oxadiazole compound, thiazole compound, imidazole compound, triphenylamine derivative, phenylenediamine derivative, aminostilbene derivative, triphenylmethane derivative, and the like. These charge-generating substances can be used singly or by mixing multiple types.

As the binding resin forming the charge-generating layer and the charge-transmitting layer the photosensitive layer, electrically insulative thermoplastic resin, thermosetting resin, photo-curable resin, photoconductive resin and the like can be used. Examples of a suitable binding resin include: thermoplastic resins such as polyvinyl chloride, polyvinyidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester resin, phenoxy resin, methacrylic resin, polystyrene, polycarbonate, polyarylate, polysulfone, polyethersulfone, ABS resin and the like; thermosetting resins such as phenolic resin, epoxy resin, urethane resin, melamine resin, isocyanata resin, alkyd resin, silicone resin, thermosetting acrylic resin and the like; and photoconductive resins such as polyvinyl carbazole, polyvinyl anthracene, polyvinyl pyrene and the like. These binding resins can be used singly or by mixing multiple types, and the binding resin is not particularly limited to these substances.

Examples of the antioxidants are as follows:

"Monophenol Compounds"

2,6-di-t-butyl-p-cresol, butylated hydroxyanisole, 2,6-di-t-butyl-4-ethylphenol, stearyl-β-(3,5-di-t-butyl-4-hydroxyphenyl)propionate, and 3-t-butyl-4-hydroxynisole.

"Bisphenol Compounds"

2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

"Polymeric Phenol Compounds"

1,1,3-tris-(2-methyl-4-hydroxy-5-t-butylphenyl)-butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherol.

"Paraphenylenediamine Compounds"

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

"Hydroquinone Compounds"

2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

"Organic Sulfur-Containing Compounds"

Dilauryl-3,3'-thiodipropionate, distearyl-3,3'-thiodipropionate, and ditetradecyl-3,3'-thiodipropionate.

"Organic Phosphorus-Containing Compounds"

Triphenylphosphine, tri(nonylphenyl)phosphine, tri(dinonylphenyl)phosphine, tricresylphosphine, and tri(2,4-dibutylphenoxy)phosphine.

Any plasticizer used for general resins, such as dibutyl phthalate or dioctyl phthalate may be used as is for the plasticizer. In this case, it is proper that the amount of plasticizer be in the range of 0 to about 30 parts by weight with respect to 100 parts by weight of the binder resin.

Any leveling agent can be added into the charge-transmitting layer. Silicone oils such as dimethyl silicone oil and methylphenyl silicone oil, and polymers and oligomers having a perfluoroalkyl group on the side chain thereof may be used as the leveling agent. The proper amount of leveling agent is in the range of 0 to 1 weight parts in relation to 100 weight parts of the binder resin.

The protective layer is a layer in which microparticles of a metal or metal oxide are dispersed in a binding resin. Substances that are transparent in relation to visible and infrared light, and that have superior electric insulative properties, mechanical strength and adhesiveness are desirable as the binding resin. Examples of a binding resin for use in the protective layer include: ABS resin, ACS resin, copolymer of olefin and vinyl monomers, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, poly(ethylene terephthalate), polyimide, acrylic resin, polymethyl pentene, polypropylene, polyphenylene oxide, polysulfone, polystyrene, AS resin, butadiene-styrene copolymer, polyurethane, polyvinyl chloride, polyvinylidene chloride, epoxy resin, and the like. Titanium oxide, tin oxide, potassium titanate, TiO, TiN, zinc oxide, indium oxide, and antimony oxide can be cited as metal oxides. To improve the abrasion resistance, a fluorine-containing resin, such as polytetrafluoroethylene, a silicone resin, or an inorganic material dispersed in these resins may be added to the protective layer. Common coating methods may be employed to form the protective layer. Further, the suitable thickness of the protective layer is 0.1 to about 10 μm.

Solvents used when manufacturing the photosensitive member 1 of the present Embodiment 1 include: chlorine group solvents such as dichloromethane, tetrahydrofuran, dioxane, toluene, cyclohexanone, methylethylketone, acetone, and the like.

Normally, flanges for supporting the photosensitive member and transmitting rotation from the main unit drive apparatus are provided on both ends of the photosensitive member that comprises a photosensitive layer on a drum-shaped electro-conductive support. Engineering plastics with superior mechanical strength such as polyamide, polyacetal, polyethylene terephthalate, polyphenylene sulfite, polyether ketone, liquid crystal polymer, polycarbonate, polyphenylene ether, polyarylate, polysulfone, polyether sulfone, polyetherimide, and polyamideimide are used for the flange. Fibers such as glass fiber and carbon fiber, and fillers and various types of additives including carbon, talc, kaolin, calcium carbonate, alumina, silica and the like are mixed in and used in order to control the mechanical strength, rigidity, and conductivity.

These flanges are pressure fitted to the drum shaped electro-conductive support, and fixed with adhesive.

Examples of the configurations of the charge roller 13 and charge apparatus 5 related to the present Embodiment 1, as well as of the image forming apparatus 100 and process cartridge 101 have be explained above, but as indicated in FIG. 3, it is possible to configure a tandem color image forming apparatus by taking as one image forming unit the photosensitive member 1 of the image forming apparatus together with the parts including the surrounding members, and by setting up several of these image forming components in parallel.

Figure 6:
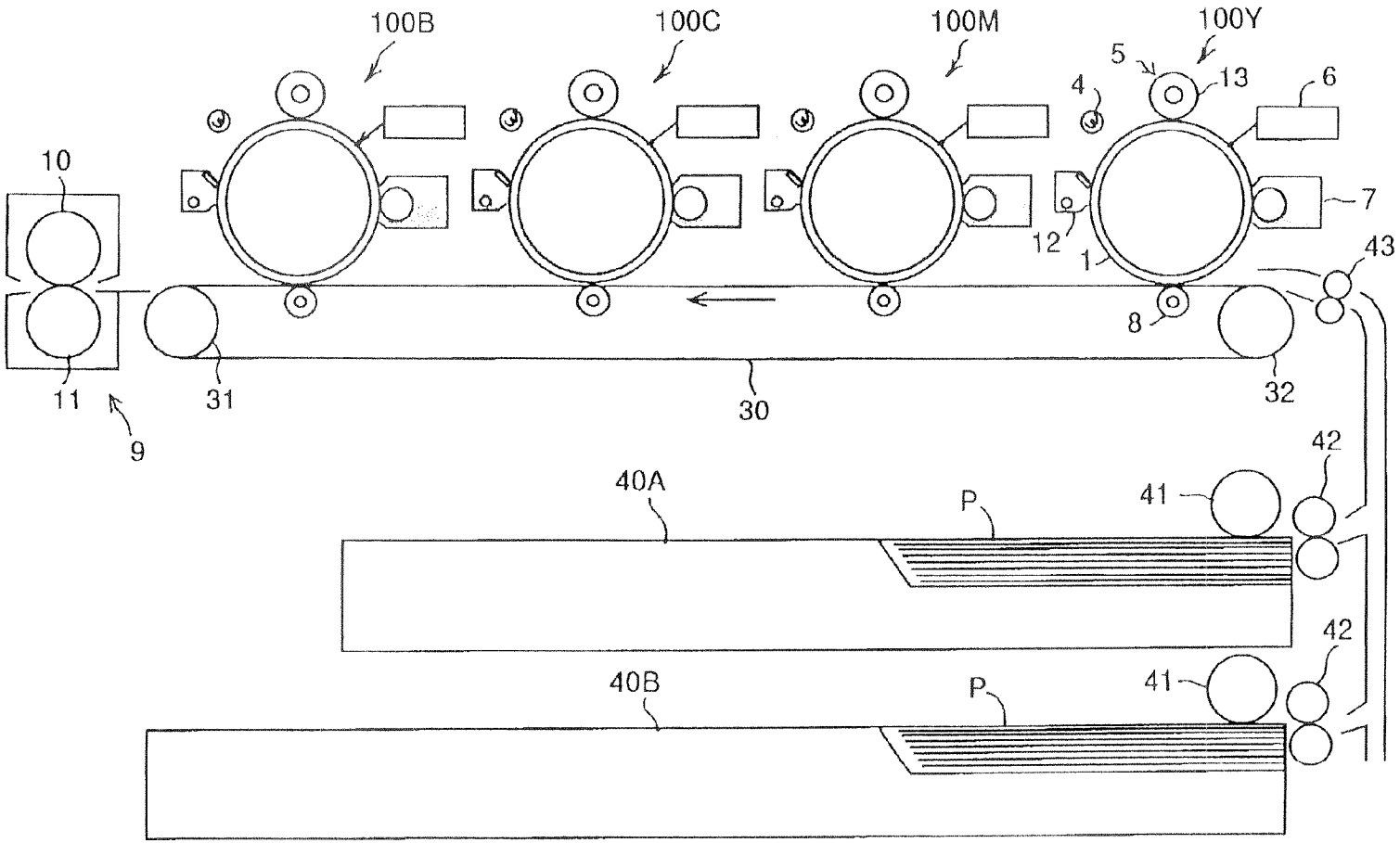
FIG. 6 is a diagram indicating the schematic configuration of a tandem color image forming apparatus.

FIG. 6 is a diagram indicating the schematic configuration of an example of a tandem color image forming apparatus related to the present Embodiment 1. This example has four image forming parts 100Y, 100M, 100C, and 100B lined up along a transfer belt 30. The configuration of the image forming parts 100Y, 100M, 100C, and 100B is each the same as in FIG. 3 with a charge apparatus 5, exposure apparatus 6, developer apparatus 7, transfer roller 8, cleaning apparatus 12 and neutralization apparatus 4 arranged in order to form images by an electronic photographic process. Further, the configuration of each of the image forming parts 100Y, 100M, 100C, and 100B is the same except that the color of the developing agent (toner) used in the developer apparatus 7 differs, and forms toner images in the colors of yellow (Y), magenta (M), cyan (C), and black (B).

The transfer belt 30 is situated between the photosensitive members 1 and transfer rollers 8 of the image forming parts 100Y, 100M, 100C, and 100B, and this transfer belt 30 is tensioned by a drive roller 31 and a driven roller 32, rotating in the direction of the arrow in the diagram. Arranged beneath the transfer belt 30 are multistage paper feed cassettes 40A and 40B that house the transfer material P such as transfer paper, and paper feed rollers 41 and separation transport rollers 42 are provided in relation to the paper feed cassettes 40A and 40B. In addition, resist rollers 43 are provided upstream in the direction of the transfer material transport toward the transfer belt 30, and the fixing apparatus 9 and a paper discharge apparatus (paper discharge roller, paper discharge tray and the like) not indicated in the diagram are provided downstream in the direction of the transfer material transport from the transfer belt 30.

In this tandem color image forming apparatus, when beginning the image forming operation, the same neutralization, charging, exposure, and development processes as in FIG. 3 are conducted by the image forming parts 100Y, 100M, 100C, and 100B, and toner images in the colors of yellow (Y), magenta (M), cyan (C), and black (B) are formed on the photosensitive members 1 at a specified time difference. Then, matching the timing of this image forming, the transfer material P is fed by the paper feed roller 41 and the separation transport rollers 42 from one of the multistage paper feed cassettes 40A, 40B, and is fed onto the transfer belt 30 by the resist rollers 43. The transfer material P fed onto the transfer belt 30 is carried by the transfer belt 30, is transported successively to the transfer areas of the image forming parts 100Y, 100M, 100C, and 100B, and toner images in the colors of yellow (Y), magenta (M), cyan (C) and black (B) are laminated and transferred in order onto the transfer material P. Continuing, the transfer material P with the transferred toner image passes through the fixing roller 10 and the pressurizing roller 11 of the fixing apparatus 9, the toner image is fixed on the transfer material by the action of heat and pressure at this time, and a color image is obtained. Meanwhile, the transfer residual toner that is not transferred to the transfer material P but remains on the surface of the photosensitive member of the image forming parts is removed by the cleaning apparatus 12 and the surface of the photosensitive member after cleaning is neutralized by the neutralization apparatus 4.

One example of a tandem color image forming apparatus was indicated above, but in this kind of tandem image forming apparatus as well, it highly preferable to unify at least the photosensitive member 1 and the charge roller 13 and the like, and when formed into a so-called process cartridge that is handled as a removable part, the maintenance characteristics are notably improved.

Figure 7:
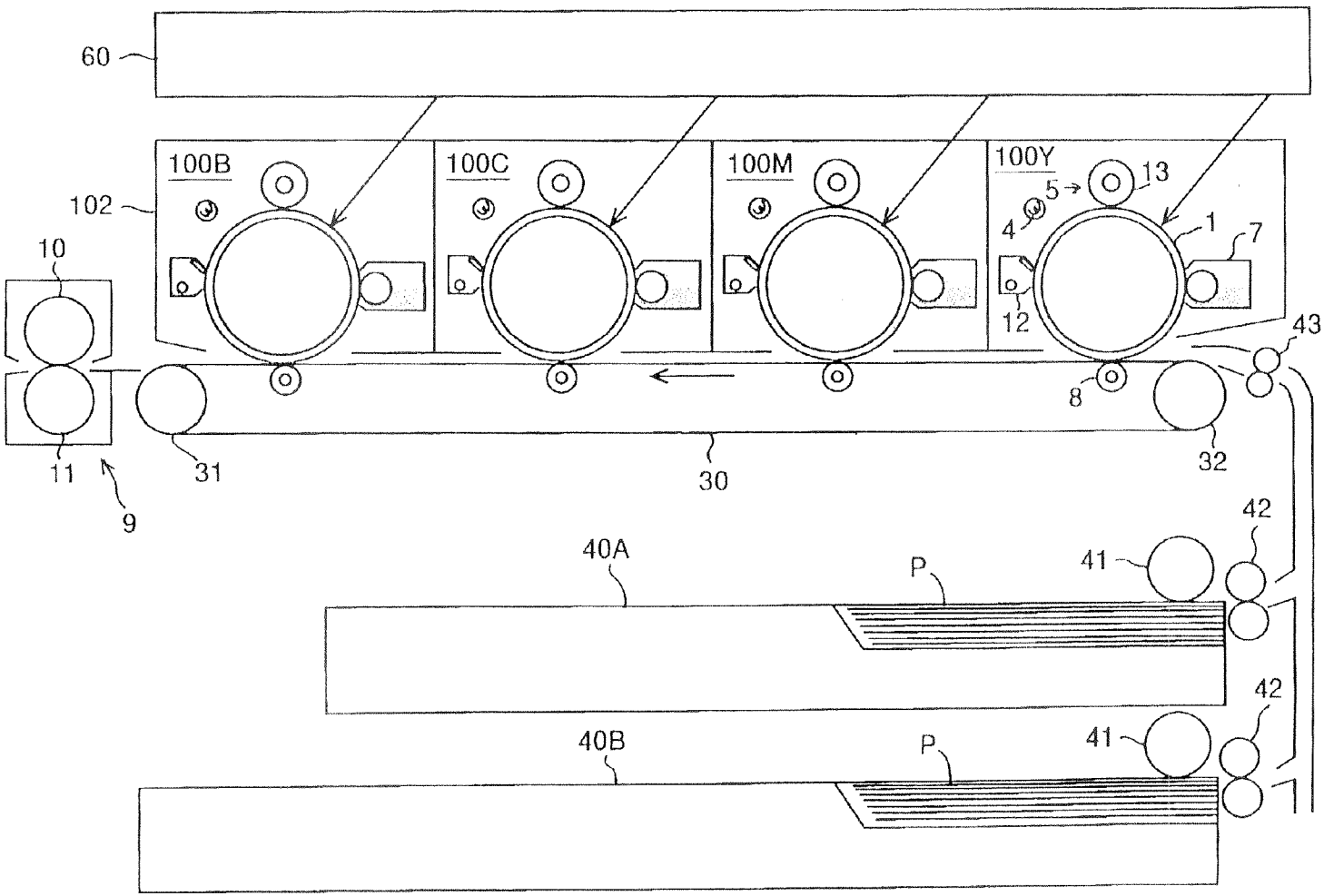
FIG. 7 is a diagram indicating the schematic configuration of a tandem color image forming apparatus that uses a process cartridge.

FIG. 7 indicates an example of the configuration of a color image forming apparatus that uses process cartridges, and in this color image forming apparatus, the photosensitive member 1, charge roller 13, developer apparatus 7, cleaning apparatus 12, and neutralization apparatus 4 of the various image forming parts 100Y, 100M, 100C, and 100B are unified and assembled into process cartridges 102; and these process cartridges 102 are configured to attach and detach freely in relation to the main unit of the image forming apparatus. Moreover, in the example of the configuration in FIG. 7, the exposure apparatus 60 is a laser scanning write apparatus comprising, for example, one light deflector and 4 sets of scanning optical systems, and is arranged outside of the process cartridges 102.

In the example of the configuration in FIG. 7, if problems occur with the photosensitive member 1 or surrounding members of the image forming parts 100Y, 100M, 100C, and 100B, the cartridge 102 can be replaced, thus notably improving the maintenance characteristics.

Further, each of the 4 image forming parts 100Y, 100M, 100C, and 100B can be individual process cartridges 101 as indicated in FIG. 5, but by housing the 4 image forming parts 100Y, 100M, 100C, and 100B in one process cartridge 102, the relationship of the arrangement of the 4 image forming parts 100Y, 100M, 100C, and 100B can be fixed, and therefore, the problem of color discrepancies caused by positional discrepancies between the image forming parts can be resolved. Moreover, because it is not necessary to adjust the positions between the image forming parts after maintenance and replacement, the maintenance characteristics can be further improved.

Further, the image forming apparatus indicated in FIG. 6 and FIG. 7 is a direct transfer tandem color image forming apparatus that uses the transfer belt 30, but the configuration of an intermediate transfer system is also possible in which the transfer belt is replaced with an intermediate transfer belt, and once the primary transfer of laminating and matching the 4 color toner images onto the intermediate transfer belt, the color toner image on the intermediate transfer belt is transferred all at once to the transfer material at a secondary transfer part.

Next, specific examples and comparative examples of the charge roller and image forming apparatus that uses the same related to the present Embodiment 1 will be explained below.

After coating an aluminum drum (electro-conductive support) having a diameter of 30 mm with an undercoat layer, a charge-generating layer, a charge-transmitting layer and a protective layer in that order, the drum was dried to produce a photosensitive member 1 comprising an undercoat layer of 4.5 μm, a charge-generating layer of 0.15 μm, a charge-transmitting layer or 22 μm, and a protective layer of approximately 4.5 μm. At this time, the protective layer was coated by spraying, and the other layers were coated by dipping. 22.0 weight % of alumina with a mean particle size of 0.21 μm was added to the protective layer. Flanges made of plastic were pressure fitted to both ends of the photosensitive member thus produced. A total of 120 photosensitive members were produced in this way. When measuring the circumferential fluctuation in the image forming region of the photosensitive member thus produced, the mean value was 35 μm, minimum value 5.1 μm, and maximum value 112. Photosensitive members with circumferential fluctuations of 5.1 μm, 5.4 μm, 35 μm, 36 μm, and 112 μm were selected from these.

Next, a IPS10 CX400 manufactured by Ricoh was used as the tandem color image forming apparatus, and the four types of charge roller trial products No. 1 to No. 4 were evaluated as the charge roller 13 of the photosensitive member unit for black. These charge rollers had carbon and ionic electroconductive materials mixed in the rubber material, and the surface conditions of the various charge rollers were different.

The center and both ends of the surfaces of the 4 types of charge rollers were photographed by SEM, lines with a distance of 0.5 mm circumferentially were drawn at 3 locations on the respective photographs, the number of stage differences crossing the lines were counted, and when investigating the number of stage differences, charge roller No. 1 had no stage differences. Next, when investigating the number of stage differences at a distance of 0.5 mm circumferentially at the 3 respective locations of the center and both ends, charge roller No. 2 had 7 to 10 stage differences. Here, all stage differences that could be confirmed in the SEM photograph were measured for the height difference of the stage difference using a 3-dimensional SEM (ERA-8900FE; manufactured by ERIONIX), and only stage differences with a height difference of 2 to 30 μm were counted.

Next, when investigating the number of stage differences at a distance of 0.5 mm circumferentially at the 3 respective locations of the center and both ends, charge roller No. 3 had 20 to 25 stage differences.

Next, when investigating the number of stage differences at a distance of 0.5 mm circumferentially at the 3 respective locations of the center and both ends, charge roller No. 4 had 45 to 52 stage differences.

The diameters of charge rollers Nos. 1 to 4 were all 11.5 mm. Gap tape with a width of 10 mm and thickness of 52 μm was affixed as a spacer at a position 13 mm from the ends of the charge roller. The charge rollers were arranged directly above the photosensitive members; the charge rollers were pressed onto the photosensitive members using springs; and evaluations were conducted by applying frequency 1100 Hz, amplitude 1200 V AC voltage onto −600 V DC voltage between the photosensitive member and the charge roller with the photosensitive member at a linear velocity of 185 mm/second.

COMPARATIVE EXAMPLE 1

Figure 8:
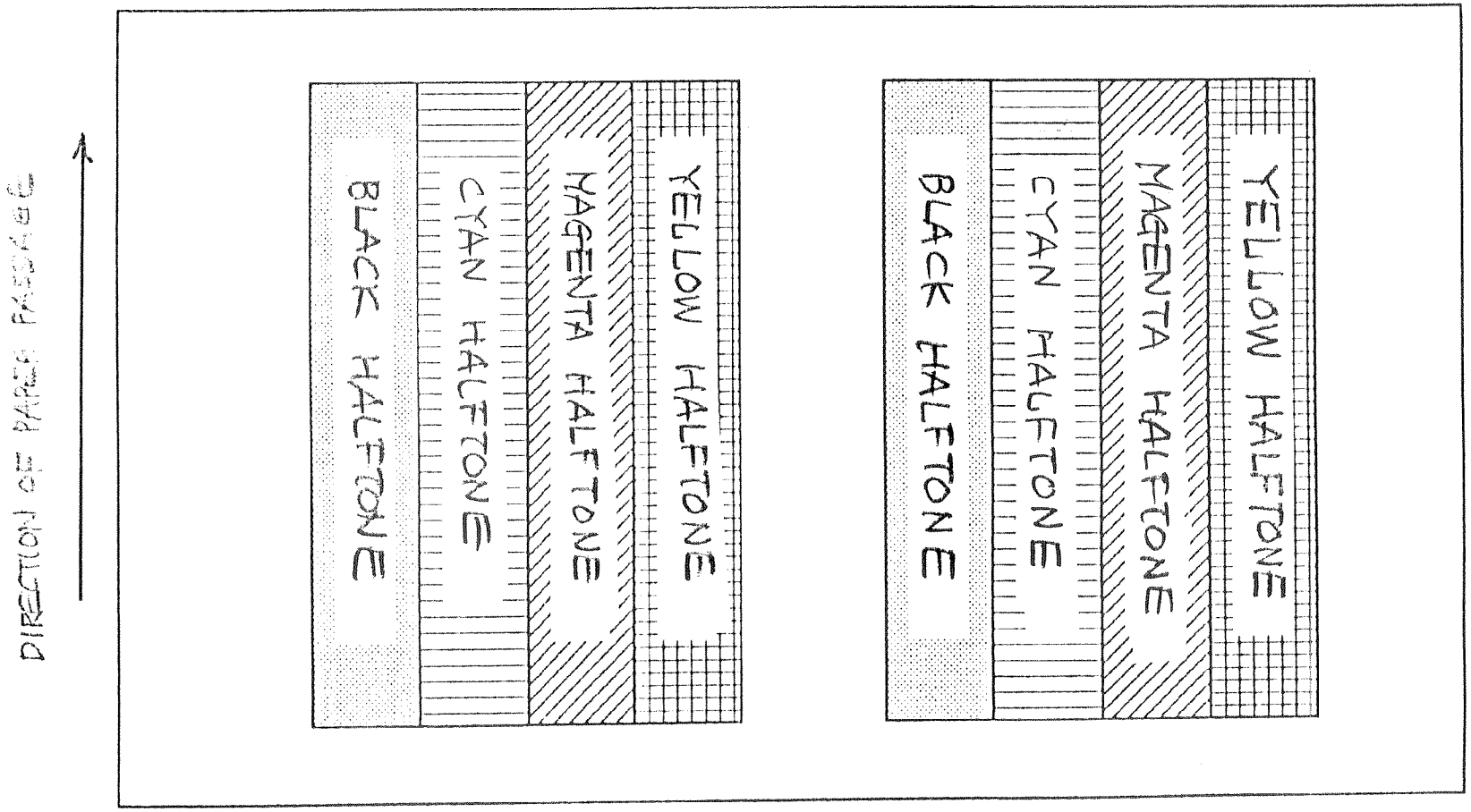
FIG. 8 is a diagram indicating an example of parallel image output of two 4-color halftone images onto A4 transfer paper.

When installing charge roller No. 1 and photosensitive members with circumferential fluctuations of 5.1 μm, 35 μm, and 112 μm into the aforementioned photosensitive member unit for black and outputting an image in which 2 sets of 4 color halftone images are lined up as indicated in FIG. 8 every 5 pages of A4 transfer paper, high quality images were obtained from the photosensitive member with circumferential fluctuations of 5.1 μm, but slight concentration irregularities were observed with the photosensitive member with circumferential fluctuations of 35 μm, and notable concentration irregularities were observed with the photosensitive member with circumferential fluctuations of 112 μm.

EXAMPLE 1

When changing the charge roller in Comparative Example 1 to charge roller No. 2, and outputting an image in which 2 sets of 4 color halftone images are lined up as indicated in FIG. 8 every 5 pages of A4 transfer paper, high quality images were obtained from the photosensitive members with circumferential fluctuations of 5.1 μm and 35 μm, but notable concentration irregularities were observed with the photosensitive member with circumferential fluctuations of 112 μm.

EXAMPLE 2

When changing the charge roller in Comparative Example 1 to charge roller No. 3, and outputting an image in which 2 sets of 4 color halftone images are lined up as indicated in FIG. 8 every 5 pages of A4 transfer paper, high quality images were obtained from the photosensitive members with circumferential fluctuations of 5.1 μm and 35 μm, but notable concentration irregularities were observed with the photosensitive member with circumferential fluctuations of 112 μm.

COMPARATIVE EXAMPLE 2

When changing the charge roller in Comparative Example 1 to charge roller No. 4, and outputting an image in which 2 sets of 4 color halftone images are lined up as indicated in FIG. 8 every 5 pages of A4 transfer paper, high quality images were obtained from the photosensitive members with circumferential fluctuations of 5.1 μm and 35 μm, but notable concentration irregularities were observed with the photosensitive member with circumferential fluctuations of 112 μm.

EXAMPLE 3 AND COMPARATIVE EXAMPLE 3

The charge rollers and photosensitive members were installed in varying combinations respectively in the photosensitive member units of the various colors of the aforementioned tandem color image forming apparatus, an image in which 2 sets of 4 color halftone images are lined up as indicated in FIG. 8 were output every 5 pages of A4 transfer paper for a total of 1500 pages and an evaluation was conducted, and after continuing to output 70,000 pages, a reevaluation was conducted.

Further, charge roller No. 1 and the photosensitive member with circumferential fluctuations of 5.1 μm were installed into the photosensitive member unit for black; charge roller No. 2 and the photosensitive member with circumferential fluctuations of 35 μm were installed into the photosensitive member unit for cyan; charge roller No. 3 and the photosensitive member with circumferential fluctuations of 36 μm were installed into the photosensitive member unit for magenta; and charge roller No. 4 and the photosensitive member with circumferential fluctuations of 5.4 μm were installed into the photosensitive member unit for yellow.

After outputting 1500 pages, slight concentration irregularities were observed in the black images developed from the photosensitive member unit for black in which the charge roller No. 1 and the photosensitive member with circumferential fluctuations of 5.1 μm were installed, and notable concentration irregularities were observed after outputting 70,000 pages.

After outputting 1500 pages and after outputting 70,000 pages, high quality images were observed in the cyan images developed from the photosensitive member unit for cyan in which the charge roller No. 2 and the photosensitive member with circumferential fluctuations of 35 μm were installed.

After outputting 1500 pages and after outputting 70,000 pages, high quality images were observed in the magenta images developed from the photosensitive member unit for magenta in which the charge roller No. 3 and the photosensitive member with circumferential fluctuations of 36 μm were installed.

After outputting 1500 pages, several slight horizontal streaks were observed in the yellow images developed from the photosensitive member unit for yellow in which the charge roller No. 4 and the photosensitive member with circumferential fluctuations of 5.4 μm were installed, and the number of horizontal streaks further increased after outputting 70,000 pages. SEM observations of the charge roller after running revealed defects produced on the edges of the stage differences on the surface of the charge roller.

As explained above, according to the present Embodiment 1, a process cartridge and an image forming apparatus can be provided in which oxidation degradation of the image support member and the charge member can be delayed and the replacement frequency reduced. Further, a high quality image forming apparatus can be provided that produces little oxidized gas and is superior for the environment. Moreover, a high image quality, high quality image forming apparatus and color image forming apparatus can be provided that can form high resolution images.

Embodiment 2

First, the present Embodiment 2 will be summarized below.

(1) The present Embodiment 2 is a photosensitive member (image support member) and an image forming apparatus that conducts charge processing by applying AC voltage superimposed on DC voltage on a charge roller arranged without making contact in relation to the photosensitive member in question, wherein circumferential fluctuations in the image formation area of the photosensitive member are 4 to 80 μm; a plurality of stage differences with a height difference of 2 to 30 μm that continue for a length of 400 μm or more are on the surface of the charge roller; and when, in order to extract this continuous stage difference to an XY plane, the longitudinal central axial line (longitudinal direction) of the charge roller is taken as the X axis direction, the distance Yn from the X axis of an optional X (Xn) is plotted at 10 points or more at an optional interval, and collinear approximation of the stage difference is conducted based on the least squares method, the correlation coefficient is 0.9 or less, and the slope is −0.5 to 0.5.

(2) The average gap between the charge roller and the image forming area of the photosensitive member of the present Embodiment 2 is 10 to 150 μm, preferably 14 to 100 μm, and more preferably 18 to 60 μm. It is not preferable that the average gap between the photosensitive member and the charge roller be less than 10 μm because the photosensitive member and the charge roller are too close, and toner that has not been cleaned off is prone to catch between the photosensitive member and the charge roller, producing abnormal images with streaks. Moreover, it is not preferable that the average gap between the photosensitive member and the charge roller be more than 150 μm because in order to cause discharge it is necessary to increase the voltage of the alternating current applied to the charge roller, and if increased too much, a large amount of ozone will be produced.

(3) The circumferential fluctuation in the image formation area of the photosensitive member used in the present Embodiment 2 is 4 to 80 μm, preferably 7 to 70 μm, and more preferably 8 to 30 μm. It is not preferable for the circumferential fluctuation of the photosensitive member to be less than 4 μm in terms that the costs precision production of the photosensitive member become extremely high, and more than 80 μm is not preferable because if the fluctuations are too large the photosensitive member and the charge roller will make violent contact and damage the photosensitive member, and the if photosensitive member and the charge roller come too close, toner that has not been cleaned off is prone to catch between the photosensitive member and the charge roller, producing abnormal images with streaks.

(4) There are a plurality of stage differences on the surface of the charge roller used in the present Embodiment 2, and height difference of the stage difference is 2 to 30 μm, preferably 3 to 20 μm, and more preferably 4 to 15 μm. A stage difference of 2 μm or less is not preferable because the effect to mitigate variations in the gap based on the stage differences does not appear, and 30 μm or more is not preferable because the most concave parts of the stage differences of the charge roller are at too great a distance from the photosensitive member and have difficulty discharging. In order to make those parts discharge it is necessary to increase the voltage of the alternating current applied to the charge roller, and if increased too much, a large amount of ozone will be produced.

(5) Preferably the stage differences of the charge roller used in the present Embodiment 2 comprise height differences of 2 to 30 μm, and the stage differences have a steep height difference with a width of 10 μm or less, preferably 5 μm or less, and more preferably between 0.1 to 3 μm. The stage differences continue across a length of at least 100 μm, preferably 400 μm. Because there are large differences in the functions of absorbing and mitigating cyclic charge irregularities that are easily noticeable to the human eye and that are produced depending on the linearity and slope of the stage differences connecting the surface of the charge roller, the linearity and slope must be stipulated. Thus, for the stage differences of the roller surface in the present Embodiment 2, the correlation coefficient and slope when conducting collinear approximation of the stage difference based on the least squares method are stipulated by taking the longitudinal direction of the charge roller as the X axis direction, and sampling and plotting the distance Yn from the X axis of an optional X (Xn) extracted to an XY plane at an interval such that the number of sampling points is 10 points or more. Because the stage differences for which sampling is conducted are high at 2 μm or more, the stage differences can be easily identified as lines by electron microscope video imaging or optical video imaging set to 30 to 1000 times.

(6) If completely linear, the collection of plot points when the continuous stage differences are extracted to an XY plane will be cyclic irregularities easily noticeable to the human eye; therefore, it is better if the continuous stage differences gradually meander, and the degree of meandering is satisfactory if the correlation coefficient when conducting collinear approximation of the stage difference based on the least squares method is 0.9 or less (excluding 0), preferably 0.4 or less (excluding 0), and more preferably 0.1 or less (excluding 0). It is not preferable for the correlation coefficient to be greater than 0.9 because the linearity is too high, and no contribution is made to mitigating cyclic irregularities.

(7) A meandering line extracted to an XY plane that extends without holding the angle in the entire longitudinal direction also is prone to generate cyclic irregularities easily noticeable to the human eye, and therefore, it is better if the continuous stage differences hold the angle, and the degree of slope is satisfactory if the slope when conducting collinear approximation of the stage difference based on the least squares method is −0.5 to 0.5, preferably −0.3 to 0.3, and more preferably −0.1 to 0.1. It is not preferable for the slope to be less than −0.5 or more than 0.5 because cyclic irregularities easily occur.

The present Embodiment 2 will be explained in detail below while referring to the diagrams.

Part of the explanation of Embodiment 1 described above will be applied as is to the present Embodiment 2. For example, the explanations relating to FIG. 1, FIG. 3, FIG. 4, and FIG. 8, the explanation of the charge roller (electro-conductive support, high-polymer layer, electro-conductive agent, surface layer, and the like), and the explanation of the photosensitive member (electro-conductive support, undercoat, charge-generating substance, charge-transmitting substance, binding resin, antioxidant, plasticizer, solvent, and the like) will be applied as is to the present Embodiment 2, and redundant explanations will be omitted. The explanation below will center on the part of the present Embodiment 2 that differs from Embodiment 1.

Figure 9:
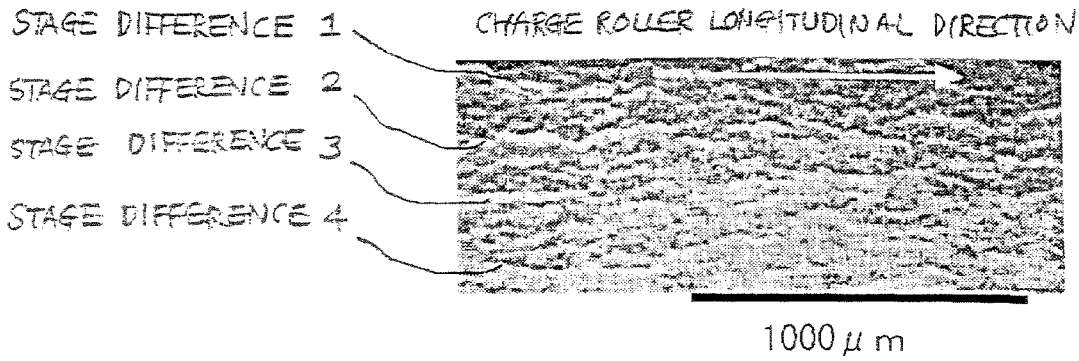
FIG. 9 is an electron scanning micrograph of the charge roller surface of Embodiment 2 of the present invention.

Indicated in FIG. 9 is an electron scanning micrograph of one example of the charge roller 13 of the present Embodiment 2. The direction of the white arrow expresses the longitudinal direction of the charge roller. Continuous stage differences in FIG. 9 are observed as streaks. Streaks equivalent to stage differences are meandering continuous lines with a thickness of about 1 μm, and a plurality is present running longitudinal (X axis direction). Because the stage differences are not straight, but rather meander, the stage differences can effectively mitigate the cyclic charge irregularities that would be anticipated if straight. Moreover, because the stage differences are not mutually parallel and each has a slope in relation to the direction of the X axis, hardly any horizontal streak irregularities are produced, which would be anticipated if all of the continuous stage differences were in the direction of the X axis. Because the stage differences have a large height difference at 2 μm or more, the stage differences can be easily identified as lines by electron microscope video imaging or optical video imaging set to 30 to 1000 times, preferably 30 to 100 times. Less than 30 times is not preferable because the resolution is low and the streaks can not be identified, and exceeding 1000 times is not preferable because sampling continuous stage differences of 400 μm or more becomes difficult. However, with the advances in microscopes even stage differences with a small height difference can be confirmed, and therefore it is important to confirm the size of the stage difference with a 3-dimensional SEM, a laser microscope, a tunneling microscope, or the like, and to extract only stage differences of 2 μm or more.

Figure 10:
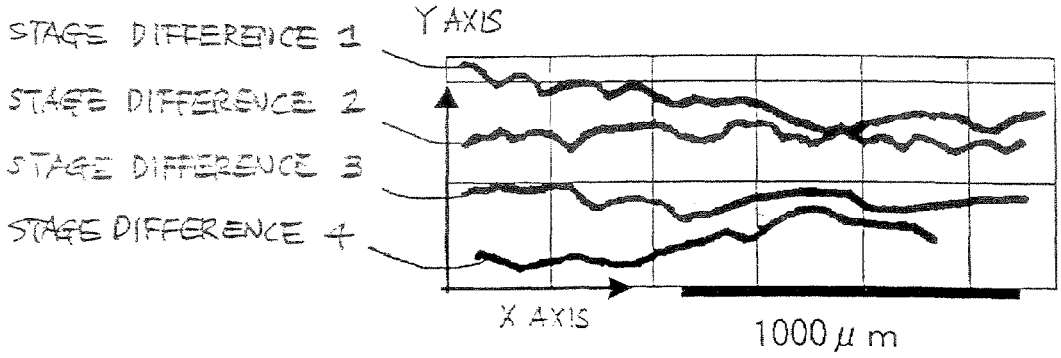
FIG. 10 is a diagram extracting the representative stage difference lines from the photograph of FIG. 9 onto an XY plane.
Figure 11:
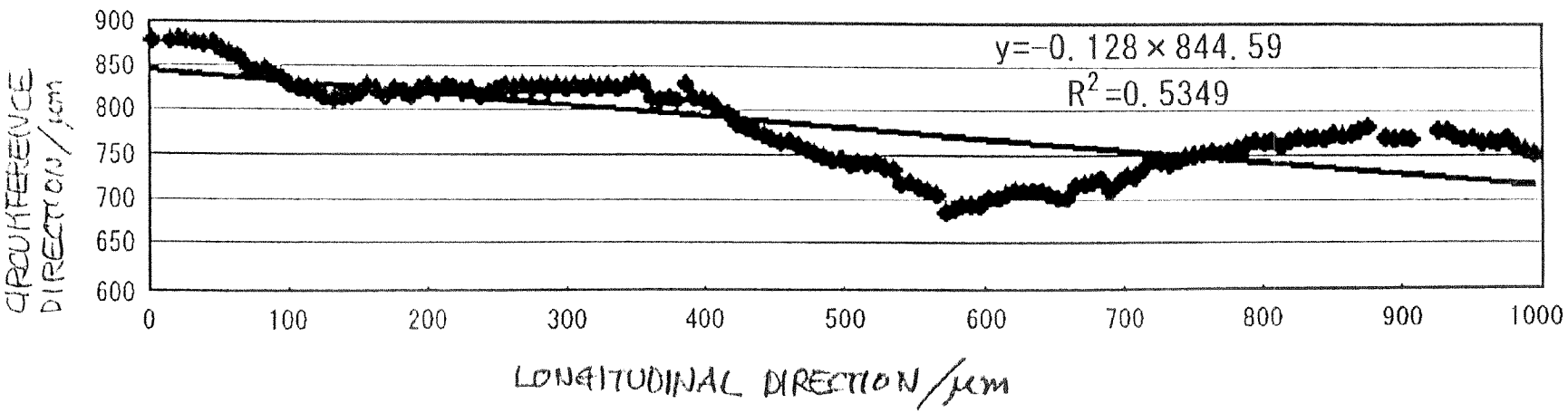
FIG. 11 is a graph to explain sampling of stage differences and conducting collinear approximation using the least squares method.

The lines with stage differences of 2 μm or more were extracted to an XY plane from the electron micrograph of FIG. 9, and are indicated in FIG. 10. It was confirmed by 3-dimensional SEM that all of the stage differences extracted here had a height difference of 2 μm or more. The respective extracted lines of stage difference were taken from the top as stage difference 1, stage difference 2, stage difference 3, and stage difference 4; the respective lines were sampled at optional intervals, collinear approximation was conducted using the least squares method, and the slope and correlation coefficient were derived. The number of sampling point is 10 points or more, preferably 15 points or more, and more preferably 20 to 100 points. The greater the number of samples at one line of stage difference, the more accurately the linear regression can be conducted, but when the number of samples becomes a fixed number or more the linearity subjected to linear regression hardly changes, and therefore, the method will be explained for deriving the suitable number of samples and for deriving the slope and correlation coefficient taking stage difference 1 as one example of linear regression. Only 1000 μm of stage difference 1 was extracted, 166 points were sampled, and when conducting collinear approximation using the least squares method, the correlation coefficient was 0.53 and the slope was −0.13 (refer to FIG. 11).

Moreover, the slope and correlation coefficient were derived in the same way for stage differences 2 to 4. Correlation coefficient 0.44, slope −0.07 was obtained for stage difference 2; correlation coefficient 0.07, slope 0.03 was obtained for stage difference 3; and correlation coefficient 0.73, slope 0.40 was obtained for stage difference 4. Ideally, it is preferable to conduct linear regression for all of the stage differences present on the surface of the charge roller, but in the stage differences related to the present embodiment 2, it is sufficient to calculate for a surface area of 0.36 to 4 $mm^2$ of the surface of the charge roller, preferably, 0.49 to 2 $mm^2$. Taking into consideration variations depending on the location on the charge roller, analysis is conducted for the stage difference in the previously described surface area for the center and one or both ends of the part equivalent to the image forming area. 85 percent or more, preferably 90% or more, and more preferably 95% or more of the stage difference has a height difference of 2 to 30 μm, and the stage difference continues for a length of 400 μm or more. The stage difference is extracted to an XY plane taking the longitudinal direction of the charge roller as the X axis, and when conducting collinear approximation based on the least squares method on the line the obtained by plotting 10 points or more at an optional interval, preferably the correlation coefficient is 0.9 or less and the slope is −0.5 to 0.5.

Methods to effectively produce stage differences on the surface of the charge roller include: producing stage differences by mechanical grinding or by a drawing means; utilizing volume changes when manufacturing the resin used in the charge roller; and pre-forming stage differences on the inner surface of the metal die in the casting process. Of these, pre-forming stage differences on the inner surface of the metal die in the casting process is preferable because the casting die is fixed, and when mass producing charge rollers, the preferred surface shape can be manufactured with satisfactory reproducibility.

Next, specific examples and comparative examples of the charge roller of the present Embodiment 2 will be explained below.

EXAMPLES 1 TO 4 AND COMPARATIVE EXAMPLES 1 TO 8

After coating an aluminum drum (electro-conductive support) having a diameter of 30 mm with an undercoat layer, a charge-generating layer, a charge-transmitting layer and a protective layer in that order, the drum was dried, plastic flanges were pressure fitted to both ends, and photosensitive members comprising an undercoat layer of 4.5 μm, a charge-generating layer of 0.15 μm, a charge-transmitting layer or 22 μm, and a protective layer of approximately 4.5 μm were produced. The protective layer was coated by spraying, and the other layers were coated by dipping. 22 weight % of alumina with a mean particle size of 0.21 μm was added to the protective layer. A total of 120 photosensitive members were produced in this way. When measuring the circumferential fluctuation in the image forming region of the photosensitive member thus produced, the mean value was 35 μm, minimum value 5.1 μm, and maximum value 36 μmm. Photosensitive members with circumferential fluctuations of 5.1 μm, 5.4 μm, 35 μm, 36 μm, and 112 μm were selected from these.

Meanwhile, four types of charge rollers were purchased from charge roller manufacturers. These charge rollers were manufactured by applying rubber material with carbon and ionic electro-conductive materials mixed into a stainless steel cylinder, and the surface conditions of the various charge rollers were different. The diameters of the charge rollers of the four types were all 11.5 μm. Gap tape with a width of 10 mm and thickness of 52 μm was affixed as a spacer at a position 13 mm from the ends of the charge roller.

The surfaces of the 4 kinds of charge roller were observed by electron microscope, and all stage differences present in 1 $mm^2$ were measured using 3-dimensional SEM (ERA-8900FE; manufactured by ERIONIX). Moreover, sampling, collinear approximation using the least squares method, and derivation of the correlation coefficient and slope were conducted regarding the stage differences present in Nos. 1 to 4 with a height difference of 2 μm or more and a continuity of 400 μm or more. In the results, charge roller No. 1 had no stage difference 2 μm or more. Charge roller No. 2 had 52 stage differences with a continuity of 400 μm or more and a height difference of 2 μm or more. When sampling the stage differences and conducting collinear approximation using the least squares method, the absolute values of the slopes were 50 or more, and the correlation coefficients were 0.7 to 0.93. Charge roller No. 3 had 45 stage differences with a continuity of 400 μm or more and a height difference of 2 μm or more. When sampling the stage differences and conducting collinear approximation using the least squares method, the absolute values of the slopes were 0.3 or less, and the correlation coefficients were 0.2 to 0.6. Charge roller No. 4 had 49 stage differences with a continuity of 400 μm or more and a height difference of 2 μm or more. When sampling the stage differences and conducting collinear approximation using the least squares method, the absolute values of the slopes were 0.5 or less, and the correlation coefficients were 0.05 to 0.3.

The charge rollers were arranged directly above the photosensitive members in the photosensitive member unit of a IPS10 CX400 (tandem color image forming apparatus manufactured by Ricoh); the charge rollers were pressed onto the photosensitive members using springs; and evaluations were conducted by applying frequency 1450 Hz, amplitude 1100 V AC voltage onto −600 V DC voltage between the photosensitive member and the charge roller with the photosensitive member at a linear velocity of 185 mm/second.

When evaluating by installing charge roller No. 1 into the photosensitive member unit for black, installing in order photosensitive members with circumferential fluctuations of 5.1 μm, 35 μm, and 112 μm, and outputting a 1 by 1 halftone image every 5 pages of A4 size paper as indicated in FIG. 6, high quality images were obtained by the photosensitive member with circumferential fluctuations of 5.1 μm, slight concentration irregularities were observed in the photosensitive member with circumferential fluctuations of 35 μm, and notable concentration irregularities were observed in the photosensitive member with circumferential fluctuations of 112 μm. (The combination of charge roller No. 1 and the 5.1 μm photosensitive member was Comparative Example 1; the combination of charge roller No. 1 and the 35 μm photosensitive member was Comparative Example 2; and the combination of charge roller No. 1 and the 112 μm photosensitive member was Comparative Example 3.)

The charge roller was changed to charge roller No. 2, and when outputting the 1 by 1 halftone image every 5 pages, fine longitudinal streaks were observed in all of the photosensitive members with circumferential fluctuations of 5.1 μm, 35 μm, and 112 μm. (The combination of charge roller No. 2 and the 5.1 μm photosensitive member was Comparative Example 4; the combination of charge roller No. 2 and the 35 μm photosensitive member was Comparative Example 5; and the combination of charge roller No. 2 and the 112 μm photosensitive member was Comparative Example 6.) The charge roller was changed to charge roller No. 3, and when outputting the 1 by 1 halftone image every 5 pages, high quality images were obtained by the photosensitive members with circumferential fluctuations of 5.1 μm and 35 μm, and notable concentration irregularities were observed in the photosensitive members with circumferential fluctuations of 112 μm. (The combination of charge roller No. 3 and the 5.1 μm photosensitive member was Example 1; the combination of charge roller No. 3 and the 35 μm photosensitive member was Example 2; and the combination of charge roller No. 3 and the 112 μm photosensitive member was Comparative Example 7.) The charge roller was changed to charge roller No. 4, and when outputting the 1 by 1 halftone image every 5 pages, high quality images were obtained by the photosensitive members with circumferential fluctuations of 5.1 μm and 35 μm, and notable concentration irregularities were observed in the photosensitive members with circumferential fluctuations of 112 μm. (The combination of charge roller No. 4 and the 5.1 μm photosensitive member was Example 3; the combination of charge roller No. 4 and the 35 μm photosensitive member was Example 4; and the combination of charge roller No. 4 and the 112 μm photosensitive member was Comparative Example 8.)

EXAMPLES 5 TO 7 AND COMPARATIVE EXAMPLE 9

Charge rollers and photosensitive members in varying combinations were installed in the photosensitive member units of the various colors of the aforementioned IPS10 CX400 (tandem color image forming apparatus manufactured by Ricoh), a 1 by 1 halftone image was output every 5 pages for a total of 1500 pages and an evaluation was conducted, and after continuing for 70,000 pages, a reevaluation was conducted. Charge roller No. 1 and the photosensitive member with circumferential fluctuations of 5.1 μm were installed into the photosensitive member unit for black; charge roller No. 3 and the photosensitive member with circumferential fluctuations of 5,4 μm were installed into the photosensitive member unit for cyan; charge roller No. 4 and the photosensitive member with circumferential fluctuations of 35 μm were installed into the photosensitive member unit for magenta; and charge roller No. 4 and the photosensitive member with circumferential fluctuations of 36 μm were installed into the photosensitive member unit for yellow. (The combination of charge roller No. 1 and the 5.1 μm photosensitive member was Comparative Example 9; the combination of charge roller No. 3 and the 5.4 μm photosensitive member was Example 5; the combination of charge roller No. 4 and the 35 μm photosensitive member was Example 6; the combination of charge roller No. 4 and the 36 μm photosensitive member was Example 7.)

After outputting 1500 pages, slight concentration irregularities were observed in the black images developed from the photosensitive member unit for black in which the charge roller No. 1 and the photosensitive member with circumferential fluctuations of 5.1 μm were installed, and notable concentration irregularities were observed after outputting 70,000 pages. After outputting 1500 pages and after outputting 70,000 pages, high quality images were observed in the cyan images developed from the photosensitive member unit for cyan in which the charge roller No. 3 and the photosensitive member with circumferential fluctuations of 5.4 μm were installed. After outputting 1500 pages and after outputting 70,000 pages, high quality images were observed in the magenta images developed from the photosensitive member unit for magenta in which the charge roller No. 4 and the photosensitive member with circumferential fluctuations of 35 μm were installed. After outputting 1500 pages and after outputting 70,000 pages, high quality images were observed in the yellow images developed from the photosensitive member unit for yellow in which the charge roller No. 4 and the photosensitive member with circumferential fluctuations of 36 μm were installed.

According to the present Embodiment 2, an image forming apparatus can be provided that can form high quality images without charge irregularities, and that can inexpensively delay oxidation degradation of the photosensitive member and charge roller, and reduces the replacement frequency. Moreover, generation of abnormal images by residual toner becoming caught between the image support/photosensitive member and the charge roller can be avoided. In addition, exact evaluations are possible. Further, high resolution images can be formed.

Various embodiments of the present invention have been explained above, but with the image forming apparatus of the present invention it is possible to form high quality images in both monochrome and color image formation, and specifically, it is possible to extend by a wide margin the use life of the photosensitive member and the charge roller while forming highly effective and high quality images in color image formation requiring high quality image formation. The image forming apparatus of the present invention is capable of color image formation, and has superior performance both: in the method of forming images by using 1 photosensitive member, and successively transferring the toner images of various colors on the photosensitive member to the transfer medium (intermediate transfer member or transfer material such as transfer paper and the like) after toners of the various colors are developed on this photosensitive member; and in the so-called tandem image forming apparatus, in which image formation is conducted by using as many photosensitive members as toner colors, developing the toners of various colors on separate photosensitive members, and then transferring to the transfer medium (intermediate transfer member or transfer material such as transfer paper and the like). In tandem image forming apparatuses, in order to suppress the production of oxidized gases such as ozone associated with charging, it is necessary to take up the charge process based on the charge roller, and the charge process using the image forming apparatus of the present invention in particular produces little oxidized gas because the charge conditions are gentle. For that reason, the image forming apparatus of the present invention not only can form high quality images with high reliability, but is a superior image forming apparatus that is excellent for the environment.

Various modifications will become possible for those skilled in the art after receiving the teachings of the present disclosure without departing from the scope thereof.

What is claimed is:

1. A charge member which is arranged electrically without making contact with a member to be charged, and which charges the member to be charged by applying AC voltage superimposed on DC voltage, wherein the charge member formed of a rotatable roller, is arranged electrically without making contact with the member to be charged having circumferential fluctuations of 4 to 80 μm within an image formation area, has a plurality of stage differences with a height difference of 2 to 30 μm on a surface of the roller, and the stage differences in the area opposing the member to be charged are five to thirty in relation to a distance of 0.5 mm in the circumferential direction of the roller.

2. The charge member as claimed in claim 1, wherein a gap between the charge member and the member to be charged within a region opposite to the member to be charged is an average of 10 to 150 μm, with the charge member and the member to be charged being at rest.

3. The charge member as claimed in claim 1, wherein the stage differences on the surface of the roller continue for a length of 400 μm or more, and when plotting the continuous stage differences respectively by extracting to an XY plane while taking the longitudinal direction of the roller as the X axis and conducting collinear approximation by the least squares method, the correlation coefficient is 0.9 or less, and the slope is −0.5 to 0.5.

4. The charge member as claimed in claim 1, wherein when there are the continuous stage differences on the surface of the roller and the continuous stage differences are plotted by extracting to an XY plane while taking the longitudinal direction of the roller as the X axis, the sampling frequency is 10 points or more per stage.

5. A charge apparatus which comprises a charge member arranged electrically without making contact with a member to be charged and a power source that applies voltage to the charge member, and in which the member to be charged is charged by applying to the charge member AC voltage superimposed on DC voltage, wherein the charge member is configured as a rotatable roller and is arranged electrically without making contact with the member to be charge with circumferential fluctuations of 4 to 80 μm in the image forming area, a plurality of stage differences having height differences of 2 to 30 μm are present on a surface of the roller, and the stage differences in the area opposite the member to be charged are five to thirty in relation to a circumferential distance of 0.5 mm of the roller.

6. The charge apparatus as claimed in claim 5, wherein the frequency of the AC voltage applied to the charge member is 800 to 2000 Hz.

7. A process cartridge used in an image forming apparatus, wherein the following are unified and assembled into a single cartridge:

a charge member which is arranged electrically without making contact with a member to be charged, and which charges the member to be charged by applying AC voltage superimposed on DC voltage, and which is formed of a rotatable roller, is arranged electrically without making contact with the member to be charged having circumferential fluctuations of 4 to 80 μm within an image formation area, has a plurality of stage differences with a height difference of 2 to 30 μm on a surface of the roller, and in which the stage differences in the area opposing the member to be charged are five to thirty in relation to a distance of 0.5 mm in the circumferential direction of the roller;

a charge apparatus that comprises a power source which applies voltage to the charge member, and which charges the member to be charged by applying AC voltage superimposed on DC voltage to the charge member; and an image support that is the member to be charged.

8. An image forming apparatus comprising an image forming unit that has an image support that is a member to be charged, charge means that charges the image support, and means to form an image on the image support, wherein the charge means comprises:

a charge member which is arranged electrically without making contact with a member to be charged, and which charges the member to be charged by applying AC voltage superimposed on DC voltage, and which is formed of a rotatable roller, is arranged electrically without making contact with the member to be charged having circumferential fluctuations of 4 to 8 μm within an image formation area, has a plurality of stage differences with a height difference of 2 to 30 μm on a surface of the roller, and in which the stage differences in the area opposing the member to be charged are five to thirty in relation to a distance of 0.5 mm in the circumferential direction of the roller; and a charge apparatus which comprises a power source that applies voltage to the charge member, and which charges the member to be charged by applying AC voltage superimposed on DC voltage to the charge member.

9. The image forming apparatus as claimed in claim 8, wherein the highest resolution at which the image forming unit can form images is 1000 dpi or more.

10. The image forming apparatus as claimed in claim 8, wherein a plurality of the image forming units are provided.

11. The image forming apparatus as claimed in claim 10, wherein images of differing colors are formed by the plurality of image forming units, and color images are formed by transferring the images of various colors to a transfer medium.

12. An image forming apparatus comprising an image forming unit that has an image support that is a member to be charged, a charge member that charges the image support, and means to form an image on the image support, wherein the image forming unit comprises a process cartridge in which the following are unified and assembled into a single cartridge:

a charge member which is arranged electrically without making contact with a member to be charged, and which charges the member to be charged by applying AC voltage superimposed on DC voltage, and which is formed of a rotatable roller, is arranged electrically without making contact with the member to be charged having circumferential fluctuations of 4 to 80 μm within the image formation area, has a plurality of stage differences with a height difference of 2 to 30 μm on a surface of the roller, and in which the stage differences in the area opposing the member to be charged are five to thirty in relation to a distance of 0.5 mm in the circumferential direction of the roller;

a charge apparatus which comprises a power source that applies voltage to the charge member, and which charges the member to be charged by applying AC voltage superimposed on DC voltage to the charge member; and an image support which is the member to be charged.

13. The image forming apparatus as claimed in claim 12, wherein the highest resolution at which the image forming unit can form images is 1000 dpi or more.

14. The image forming apparatus as claimed in claim 12, wherein a plurality of the image forming units are provided.

15. The image forming apparatus as claimed in claim 14, wherein images of differing colors are formed by the plurality of image forming units, and color images are formed by transferring the images of various colors to a transfer medium.

16. An image forming apparatus that conducts a charging process by applying AC voltage superimposed on DC voltage to an image support and a charge roller arranged electrically without making contact with the image support, wherein circumferential fluctuations, in the image forming area, of the image support are 4 to 80 μm, the charge roller has a plurality of stage differences on the surface thereof that have height differences of 2 to 30 μm and lengths of 400 μm or more, and when plotting the continuous stage differences respectively by extracting to an XY plane taking the longitudinal axis of the roller as the X axis and conducting collinear approximation by the least squares method, the correlation coefficient is 0.9 or less, and the slope is −0.5 to 0.5.

17. The image forming apparatus as claimed in claim 16, wherein the gap between the charge roller and the image forming area of the image support is in an average of 10 to 150 μm when the image support and the charge roller are at rest.

18. The image forming apparatus as claimed in claim 16, wherein 85% of the stage differences in a 0.36 to 4 $mm^2$ area of the center of the charge roller circumferential surface and one or both ends of the charge roller equivalent to the image forming area have a height difference of 2 to 30 μm, and a continuous length of 400 μm or more.

19. The image forming apparatus as claimed in claim 16, wherein the sampling frequency when plotting by extracting the plurality of stage differences to an XY plane is 10 points or more.

20. The image forming apparatus as claimed in claim 16, wherein the highest resolution at which images can be formed is 1000 dpi or more.

21. A process cartridge that can be mounted in an image forming apparatus, wherein the image forming apparatus conducts a charging process by applying AC voltage superimposed on DC voltage to an image support and a charge roller arranged electrically without making contact with the image support, circumferential fluctuations in the image forming area of the image support are 4 to 80 μm, the charge roller has a plurality of continuous stage differences on the surface thereof that have height differences of 2 to 30 μm and lengths of 400 μm or more, and when plotting the stage differences respectively by extracting to an XY plane taking the longitudinal axis of the roller as the X axis and conducting collinear approximation by the least squares method, the correlation coefficient is 0.9 or less, and the slope is −0.5 to 0.5.

* * * * *